United States Patent [19]

Yamada et al.

[11] Patent Number: 4,569,192

[45] Date of Patent: Feb. 11, 1986

[54] APPARATUS FOR PRODUCING SPECIAL YARNS

[75] Inventors: Yoshiharu Yamada, Toyonaka; Hirotaka Nishikawa, Ichinomiya; Hachirou Yokoyama, Aichi, all of Japan

[73] Assignees: Howa Kogyo Kabushiki Kaisha, Aichi; Daiichi Bouseki Kabushiki Kaisha, Osaka, both of Japan

[21] Appl. No.: 676,734

[22] Filed: Nov. 30, 1984

[30] Foreign Application Priority Data

Dec. 2, 1983 [JP] Japan ..... 58-228901

[51] Int. Cl.[4] ..... D01H 5/32

[52] U.S. Cl. ..... 57/317; 57/91; 57/264; 57/265; 57/328; 57/409; 19/238

[58] Field of Search ..... 57/90, 91, 317, 264, 57/265, 409, 328; 19/237–240

[56] References Cited

U.S. PATENT DOCUMENTS

| | | | |
|---|---|---|---|
| 3,449,899 | 6/1969 | Cureton et al. | 57/317 |
| 3,868,496 | 2/1975 | Pugh | 377/52 |
| 4,073,125 | 2/1978 | Bolli | 57/317 |
| 4,160,359 | 7/1979 | Frentress | 57/409 |

FOREIGN PATENT DOCUMENTS 1167156 10/1969 United Kingdom .

*Primary Examiner*—John Petrakes

*Attorney, Agent, or Firm*—Michael N. Meller

[57] ABSTRACT

An apparatus for producing special yarn made of a fiber strand in which a number of fibers are randomly arranged along the lengthwise direction thereof, in which special yarn at least one of the yarn structural parameters, e.g., yarn count number or number of twist, changes along the lengthwise direction of the yarn.

A pattern of change of the parameters of the yarn structure with respect to the length of the special yarn to be produced is stored in a central processing device, while a spun length of the special yarn is measured by a sensor. The yarn structural parameters are changed to correspond to the pattern set to the central processing device and the special yarn is produced by the yarn forming device using another central processing device of the spinning frame.

This apparatus can be used for a ring spinning frame, an open end spinning frame, a fasciated yarn spinning frame, and the like.

5 Claims, 26 Drawing Figures

START

9
INPUT OF INITIAL SET VALUE Ae, D, K
10
PATTERN LOAD ?
YES
LOAD
11
NO
NO
MACHINE OPERATE ?
12
YES
NO
YARN LENGTH MEASURING PULSE ON ?
13
14
YES
SETTING THE SLUB DATA CALCULATION OF SERVO MOTOR ROTATION NUMBER N1, N2
15
DISCRIMINATION OF THE CHANGE OF YARN COUNT ON ?
OFF
ON
16
OUTPUT OF N1, N2
OFF
DISCRIMINATION OF SLUB ON ?
17
ON
18
OUTPUT OF SLUB DATA 9
8
2e
7
106
121
113
122
123
122a
124
(61)
107
110
101b
24
25
33
55
21
44
54
36
36
52
46
43a
101
125
51
43
57a
57
58
22
101a
X
Y
4b
4a
4
63
64
62

APPARATUS FOR PRODUCING SPECIAL YARNS

BACKGROUND OF THE INVENTION

1. Field of the Invention

The present invention relates to an apparatus for producing special yarn made of a fiber strand in which a number of fibers are randomly arranged along the lengthwise direction thereof, in which special yarn at least one of the yarn structural parameters, e.g., yarn count number or number of twists, changes along the lengthwise direction of the yarn.

2. Description of the Related Art

Japanese Examined Patent Publication (Kokoku) No. 38-15968 discloses an apparatus for producing special yarn in which operation levers of a plurality of continuous speed changing devices, arranged within each transmission system between a back-roller, a front roller, and spindles, are successively connected with a driving shaft of a servo motor. The servo motor is controlled by a signal emitting device which follows a pattern cam, and slubs are produced in the yarn.

In the above apparatus, however, the pattern of the special yarn is set by the pattern cam. It takes many hours to change the pattern. As a result, it is not possible to produce special yarns having several types of patterns within a short time. Further, there are many limitations when preparing a pattern to change the yarn count number. Therefore, it is difficult to produce the special yarn having a luxurious appearance.

SUMMARY OF THE INVENTION

The present invention aims to eliminate the above problems in the prior art and proposes an apparatus for easily producing a special yarn in which one or more of the yarn constructive parameters, such as not only the yarn count number, but also the number of twists or the like, can be changed, which change of the pattern of change of the yarn constructive parameters can be effected in a short time.

Considerable advances have been made in spinning technology in recent years. Open end spinning frames, fasciated yarn spinning frames, and the like with different yarn forming principles than the conventional ring spinning frames have come into practical use. Therefore, another object of the present invention is to provide an apparatus for producing special yarn which can be adapted to the above different spinning techniques.

Considering the above problems, an apparatus for producing special yarns in accordance with the present invention which can be adapted to any yarn forming principles such as of the ring-spindle mechanism, rotating rotor mechanism, or yarn-forming mechanism using air jet nozzles must have the following:

a. means for forming yarn from a fiber strand by means of the yarn forming mechanism;
b. means for feeding the fiber strand to the yarn forming mechanism;
c. means for changing at least one of the parameters of the yarn structure of the special yarn formed by the yarn forming means partially along the lengthwise direction thereof;
d. pattern setting means for setting a pattern of change of the parameters of the yarn structure with respect to length of the special yarn to be produced;
e. means for storing control data indicating the pattern set by the pattern setting means;

f. length measuring means for measuring spun length of the special yarn;
g. control means which operates the parameter changing means on the basis of the control data of the memory means with respect to a length measuring signal of the length measuring means and which changes the yarn constructive parameter of the spinning yarn to correspond to the pattern set by the pattern setting means.

As described hereinbefore, since the apparatus in accordance with the present invention is meant to be adaptable to a ring-spindle mechanism, rotating rotor, or yarn forming mechanism using air jet nozzles, various parameter changing means must be used depending on the yarn forming mechanisms. However, the essential technical idea is completely the same.

The means for setting the pattern of change of the parameters of the yarn structure of the special yarn and the means which store the control data indicating the pattern set by the above means and control operation of the parameter changing means by the control data of the stored pattern during spinning are a microcomputer having a memory device and a central processing device, respectively. These cooperate as an electric control unit. It is practical that the former be used as common microcomputer for several spinning frames.

In the apparatus for producing the special yarn in accordance with the present invention, the pattern of change of at least one of the parameters of yarn structure with respect to the length of the special yarn to be produced is preset by the pattern setting means, the memory means stores the pattern of change of the parameter, the spun length is measured by the length measuring device during yarn spinning, the parameter changing means is activated based on the control data of the memory means with regard to the length measuring signal of the length measuring device, and special yarn having a desired pattern of change for the yarn constructive parameter is easily produced.

DESCRIPTION OF THE PREFERRED EMBODIMENTS

First, an embodiment where the yarn forming device is a ring-spindle twisting and winding mechanism, and the yarn count number and the twist number are adopted as the yarn constructive parameters is described.

Figure 1:
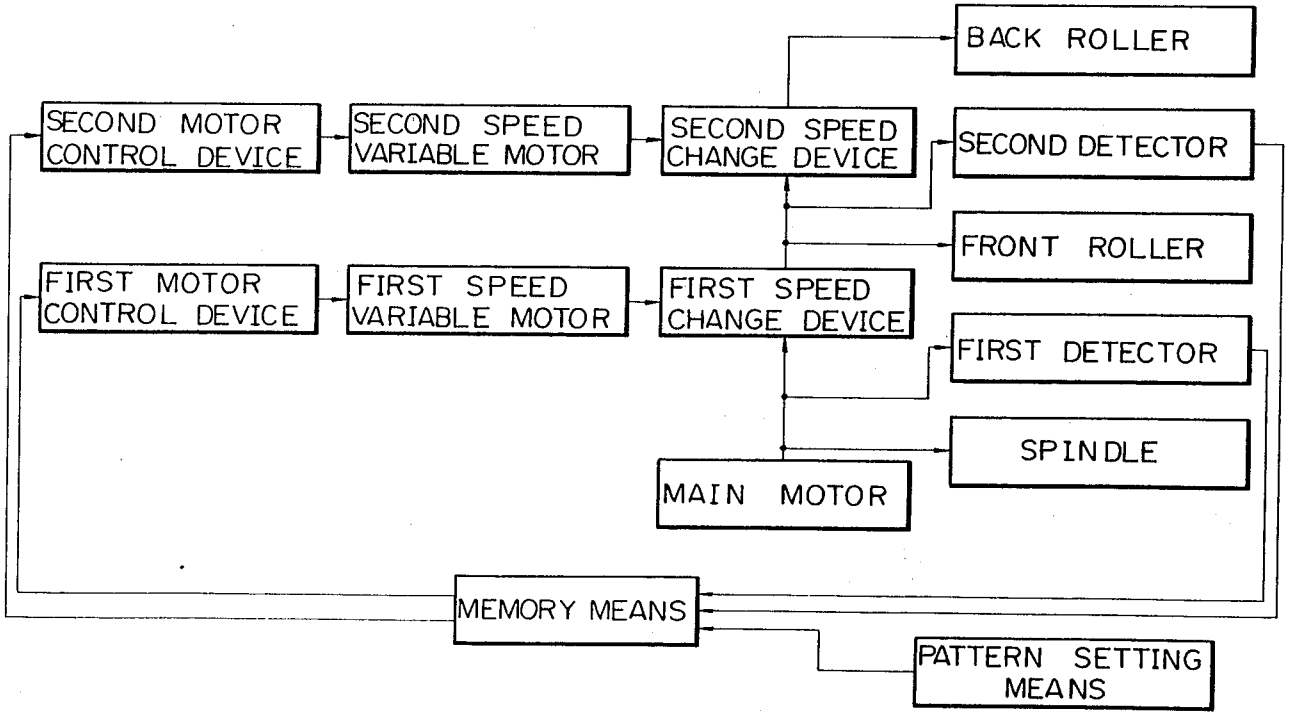
FIG. 1 is an explanatory view of the construction of an apparatus for producing special yarn according to the present invention as adapted to a ring spinning frame and using the yarn count number and twist number as the yarn constructive parameters.

The apparatus of the above first embodiment of the present invention is characterized by including, as shown in FIG. 1, a first speed change device utilizing a first speed-variable motor, arranged in a transmission system between a spindle and a front roller of a spinning frame; a second speed change device utilizing a second speed-variable motor, arranged in a transmission system between the front roller and a back roller; pattern setting means for setting a pattern of change of the yarn count number with respect to the length of a special yarn to be produced; memory means for storing therein control data indicating the pattern set by the pattern setting means; a length measuring device for measuring the spun length; a second motor control device for controlling the second speed-variable motor with respect to a length measuring signal of the length measuring device based on control data of the memory means and changing the count number of a spun yarn according to the set pattern; and a first motor control device for controlling the first speed-variable motor with respect to the length measuring signal of the length measuring device based on control data of the memory means and changing a twist number of the spun yarn according to the count number.

Figure 2:
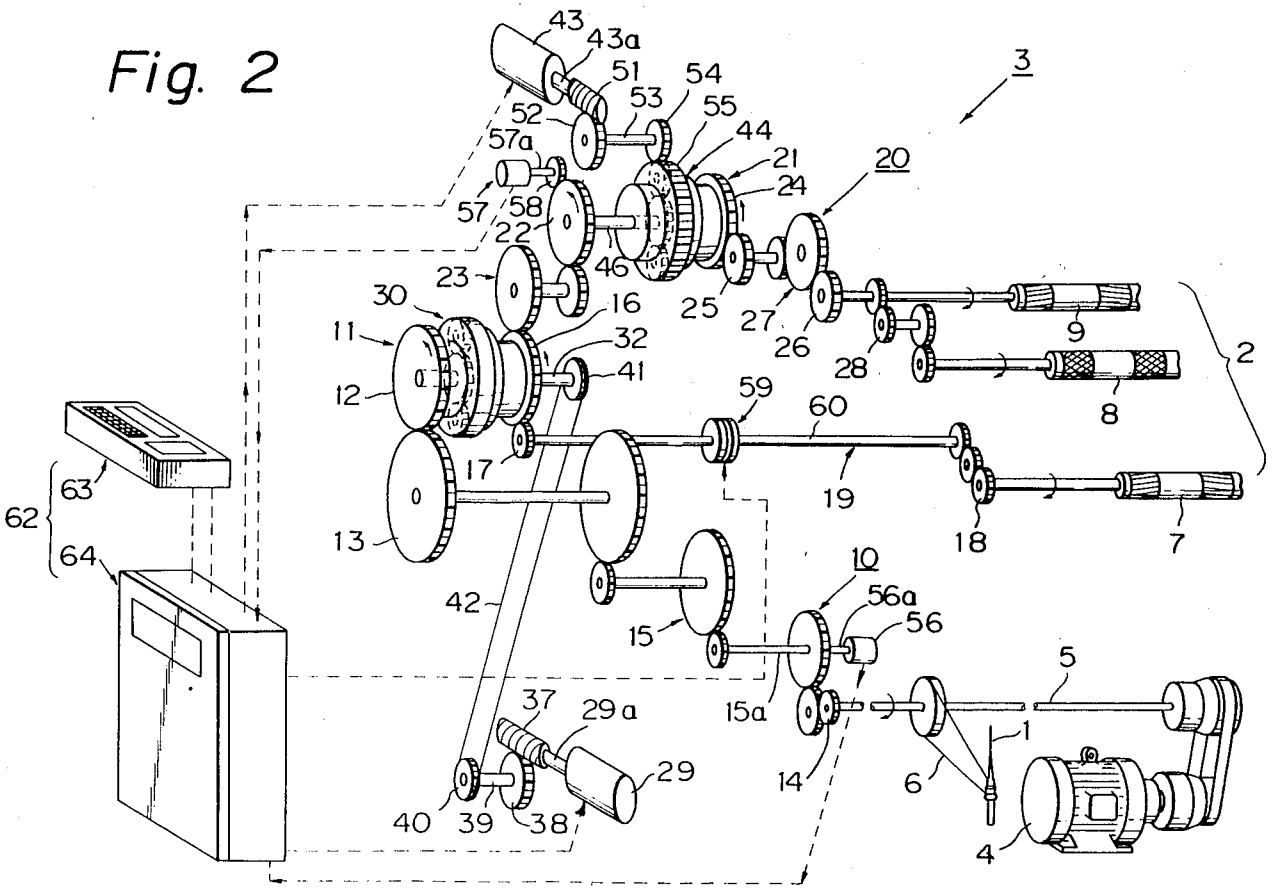
FIG. 2 is a perspective view of the main portion of the construction, especially the driving mechanism, of the apparatus of FIG. 1.

FIG. 2 is a perspective view of the main portion of the construction of the apparatus of FIG. 1. In FIG. 2, there is illustrated a driving device 3 for a spindle 1 and a drafting zone 2 in a spinning frame. As is well known, this spindle 1 is rotated through a belt 6 by a driving shaft 5 rotated by a main motor 4. The spindle 1 may also be rotated by a tangential belt. The drafting zone 2 shown in FIG. 2 is a three-line type drafting zone including a front roller 7, a second roller 8, and a back roller 9, but the drafting zone is not limited to that shown in FIG. 2. A transmission system 10 between the front roller 7 and the spindle 1 includes a first speed change device 11 arranged at a point midway of the transmission system 10, a first transmission mechanism 15 for transmitting rotation of a gear 14 secured to the driving shaft 5 to a gear 13 engaged with an input gear 12 of the first speed change device 11, and a second transmission mechanism 19 for transmitting rotation of a gear 17 engaged with an output gear 16 of the first speed change gear 11 to a gear 18 secured to the front roller 7. A transmission system 20 between the front roller 7 and the back roller 9 includes a second speed change device 21 arranged at a point midway of the transmission system 20, a third transmission mechanism 23 for transmitting rotation of the output gear 16 of the first speed change device 11 to an input gear 22 of the second speed change device 21, a fourth transmission mechanism 27 for transmitting rotation of a gear 25 engaged with an output gear 24 of the second speed change device 21 to a gear 26 secured to the back roller 9, and the above-mentioned second transmission mechanism 19. The rotation of the back roller 9 is increased at a predetermined ratio by a gear line 28, and the second roller 8 is rotated at an increased speed.

Figure 3:
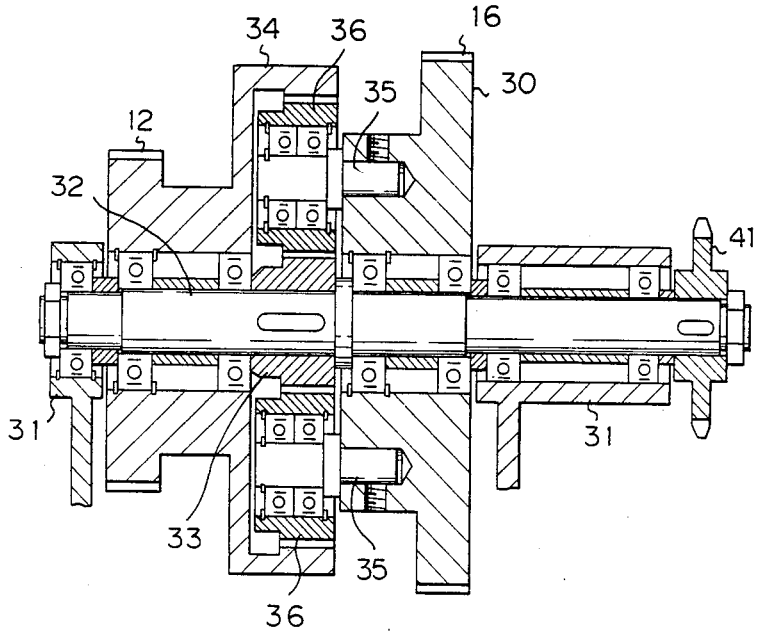
FIG. 3 is a cross-sectional view along a main shaft of a first speed change device of FIG. 2.

The first speed change device 11 includes a first differential gear 30 controlled by a first servo motor 29 arranged as the first speed-variable motor. As shown in FIG. 3, this differential gear 30 includes a main shaft 32 rotatably supported by shaft bearings 31, a sun wheel gear 33 wedged to the main shaft 32, input and output gears 12 and 16 rotatably assembled to the main shaft 32 on both the sides of the sun wheel gear 33, respectively, an inner gear 34 constructed integrally with the input gear 12, and a plurality of planetary gears 36 rotatably supported on the side face of the output gear 16 through a pin 35 and engaged with the sun wheel gear 33 and inner gear 34. In this differential gear 30, if the input gear 12 is rotated in the state where the rotation of the main shaft 32 is stopped, the inner gear 34 is rotated integrally with the input gear 12 to rotate the planetary gears 36. Since the planetary gears 36 are engaged with the sun wheel gear 33, the rotation of which is stopped, the planetary gears 36 make a planetary movement around the periphery of the sun wheel gear 33 to rotate the output gear 16 in the same direction as the rotation direction of the input gear 12 at a reduced rotation number. If the main shaft 32 is rotated in the same direction as the rotation direction of the input gear 12 in the state where the input gear 12 is rotated, the speed of the output gear 16 is increased, and if the main shaft 32 is rotated in the direction opposite to the rotation direction of the input gear 12, the speed of the output gear 16 is reduced. A worm 37 is secured to a rotation shaft 29*a* of the servo motor 29, and a chain wheel 40 is secured to a shaft 39 of a worm wheel 30 engaged with this worm 37. A chain 42 is wound around the chain wheel 40 and a chain wheel 41 secured to the main shaft 32 so that the speed change ratio of the first differential gear 30 can be changed by normal and reverse rotations of the rotation shaft 29*a* of the first servo motor 29.

Figure 4:
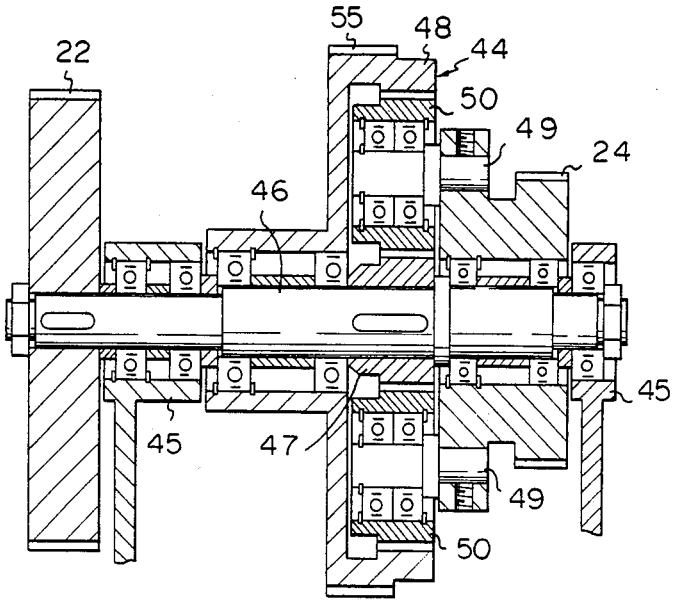
FIG. 4 is a cross-sectional view along a main shaft of a second speed change device of FIG. 2.

The second speed change device 21 includes a second differential gear 44 controlled by a second servo motor 43 arranged as the second speed-variable motor. As shown in FIG. 4, the second differential gear 44 includes a main shaft 46 rotatably supported by bearings 45, input and sun wheel gears 22 and 47 wedged to the main shaft 46, inner and output gears 48 and 24 rotatably assembled to the main shaft 46 on both the sides of the sun wheel gear 47, respectively, and a plurality of planetary gears 50 rotatably supported on the side face of the output gear 24 through a pin 49 and engaged with the sun wheel gear 47 and inner gear 48. In this second differential gear 44, if the input gear 22 is rotated in the state where the rotation of the inner gear 48 is stopped, the main shaft 46 and sun wheel shaft 47 are integrally rotated to rotate the planetary gears 50, and since the planetary gears 50 are engaged with the inner gear 48, the rotation of which is stopped, the planetary gears 50 make a planetary movement around the inner circumference of the inner gear 48 to rotate the output gear 24 in the same direction as the rotation direction of the input gear 12 at a reduced speed. If the inner gear 48 is rotated in the same direction as the rotation direction of the input gear 22 when the input gear 22 is rotated, the rotation speed of the output gear 24 is increased, and if the inner gear 48 is rotated in the direction opposite to the rotation direction of the input gear 22, the speed of the output gear 24 is reduced. A worm 51 is secured to a rotation shaft 43*a* of the second servo motor 43, and a gear 54 is secured to a shaft 53 of a worm wheel 52 engaged with the worm 51. This gear 54 is engaged with a gear 55 arranged on the periphery of the inner gear 48 so that the speed change ratio of the second differential gear 44 is changed by normal and reverse rotations of the rotation shaft 43*a* of the second servo motor 43.

Reference numeral 56 represents a first pulser arranged as the first detector for detecting the rotation number of the spindle 1. A detection shaft 56*a* of the first pulser 56 is connected to a transmission shaft 15*a* of the first transmission mechanism 15. Reference numeral 57 represents a second pulser arranged as the second detector for detecting the rotation number of the front roller 7, and a gear 58 secured to a detection shaft 57*a* of the second pulser 57 is engaged with the input gear 22 of the second differential gear 44. The second pulser 57 also acts as a length-measuring device for measuring the spun length and generating a length measuring pulse as the length measuring signal. The length measuring pulse emitted from the second pulser 57 is emitted every time a spun yarn is fed by a standard unit length (for example, 1 cm) according to a set pattern, described hereinafter, by the front roller 7. The interval of emission of the length measuring pulses is, for example, 0.058 second where the count number is 20 and the rotation number of the spindle is 5,000 rpm. The length-measuring device may be arranged independently from the second pulser 57. Reference numeral 59 represents an electromagnetic clutch arranged at a point midway of a transmission shaft 60 of the second transmission mechanism 19, and the electromagnetic clutch 59 is arranged so that when the electromagnetic clutch 59 is opened, rotation of the front roller 7 is stopped. This electromagnetic clutch 59 is disposed to form slubs on a spun yarn. That is, by temporarily stopping or reducing the rotation of the front roller 7, slubs are formed on the spun yarn. Incidentally, this electromagnetic clutch 59 may be omitted where the formation of slubs is not necessary.

Figure 5:
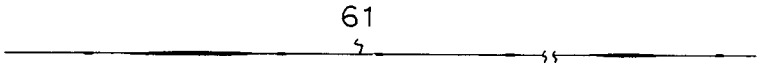
FIG. 5 is an enlarged side view of an embodiment of the special yarn produced by the apparatus of FIGS. 1 and 2.
Figure 6:
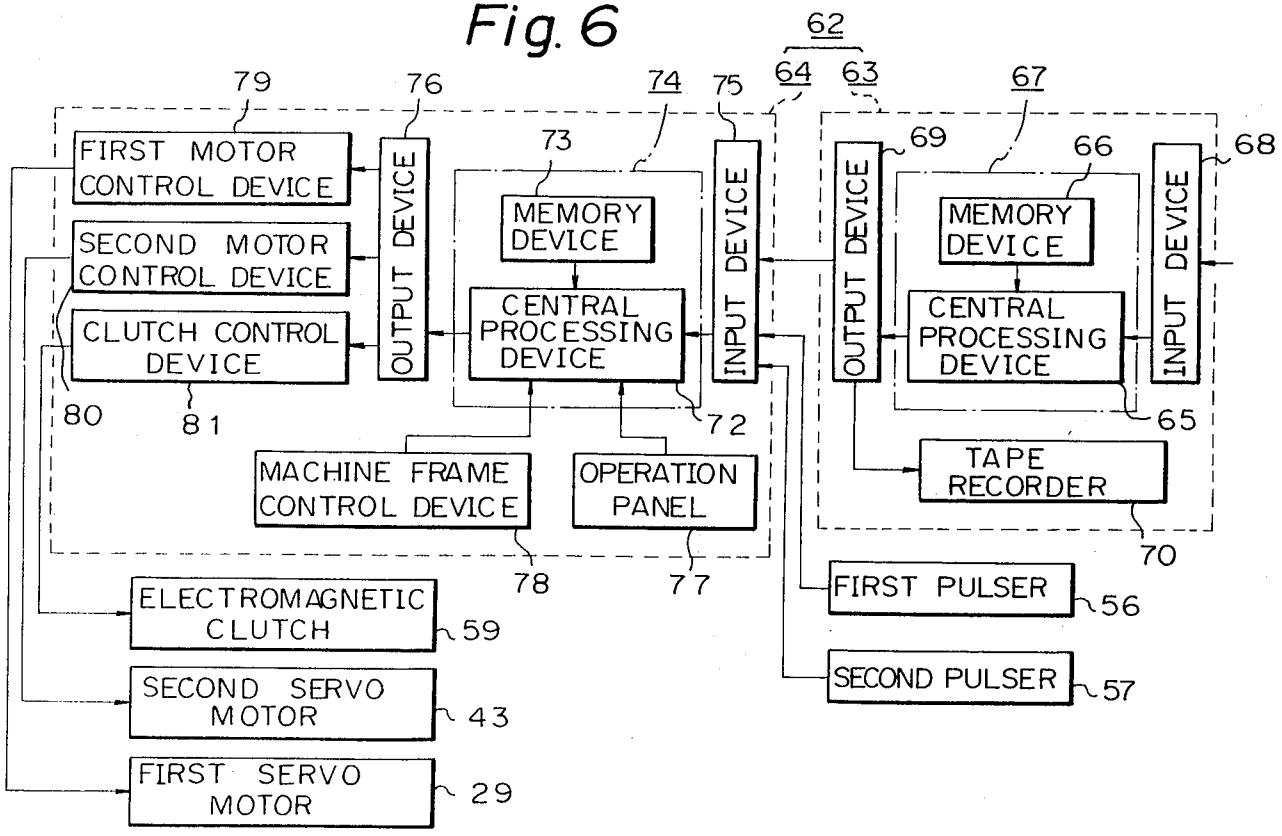
FIG. 6 is a block diagram of an electric control unit used in the apparatus of FIGS. 1 and 2.
Figure 7:
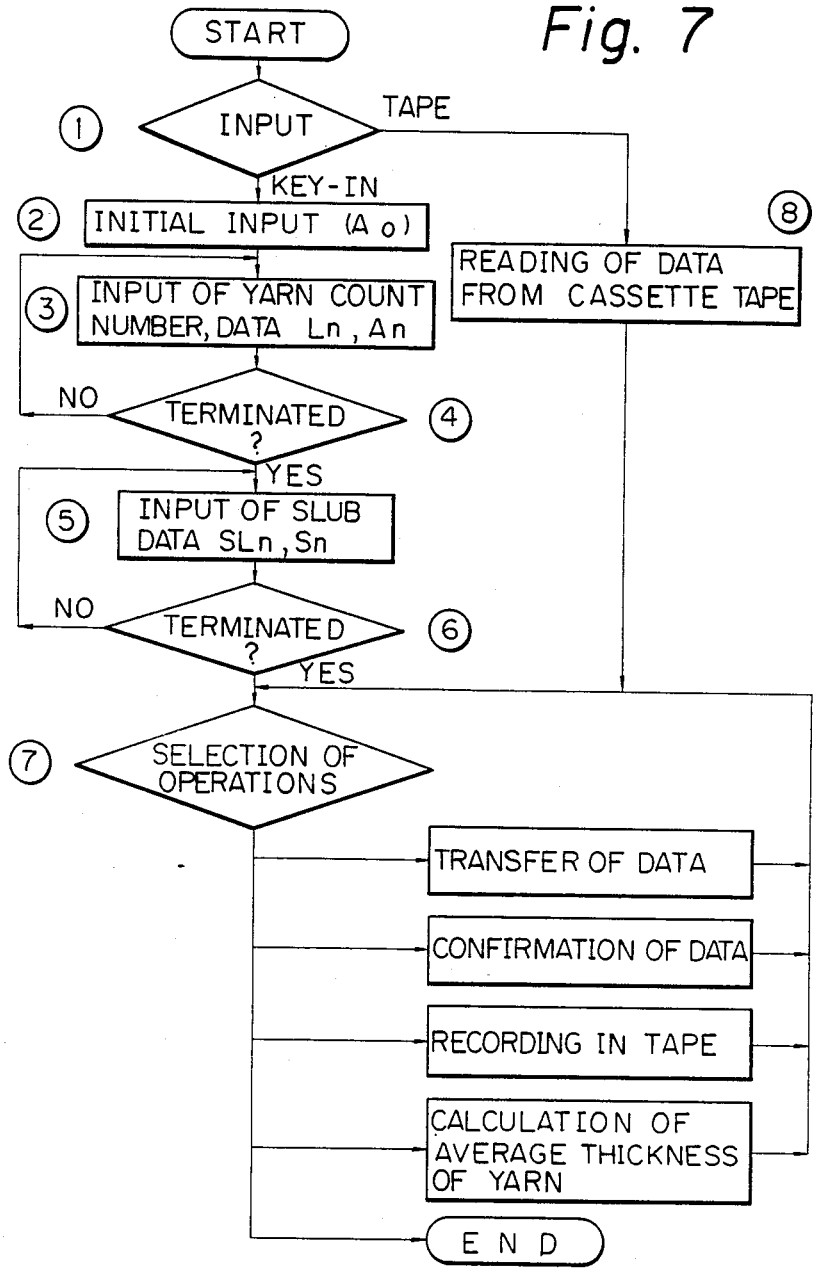
FIG. 7 is a flow chart of the procedure for setting a pattern is accordance with the electric control unit of FIG. 6.
Figure 8:
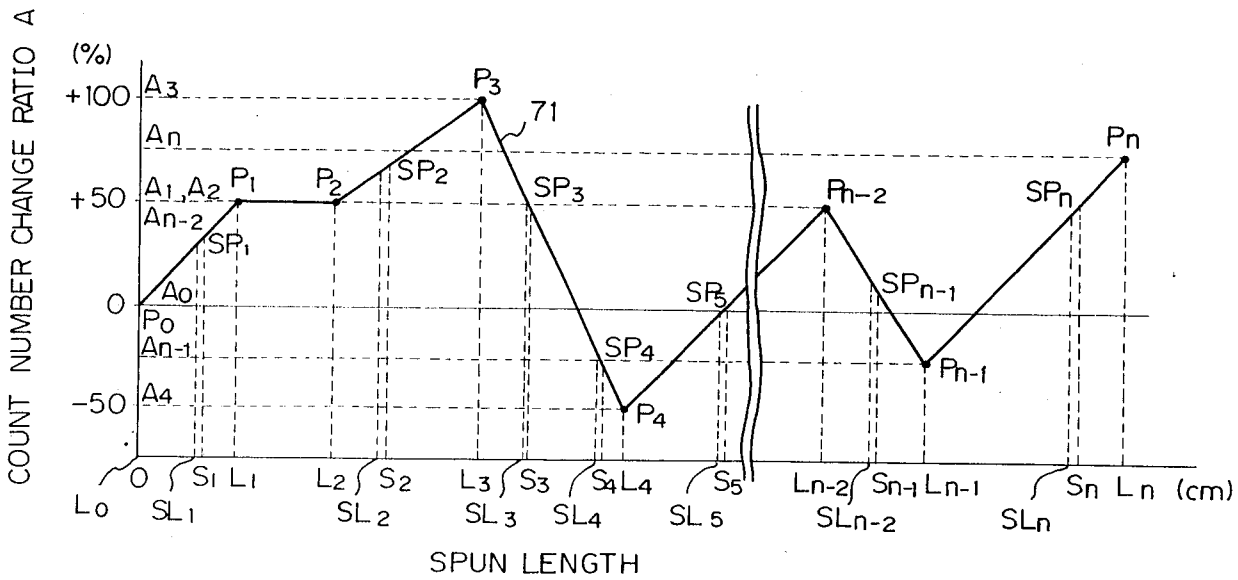
FIG. 8 is an explanatory view of an embodiment of a set pattern of special yarn produced by the apparatus of FIGS. 1 and 2.

An electric control unit 62 for producing a special yarn 61 as shown in FIG. 5 by controlling operations of the first servo motor 29, second servo motor 43, and electromagnetic clutch 59 will now be described. As shown in FIG. 6, the electric control unit 62 includes a first computer 63 for setting a pattern of the special yarn 61 and a second computer 64 for storing therein control data representing the pattern set by the first computer 63 and controlling operations of the first servo motor 29, second servo motor 43, and electromagnetic clutch 59 during spinning based on control data of the stored pattern. A portable computer such as a commercially available pocket computer is arranged as the first computer 63 so as to reduce the manufacturing cost. Furthermore, this first computer 63 acts as the first computer for a plurality of spinning frames, and this first computer 63 is carried to the vicinity of the second computer 64 of each spinning frame to input control data of the set pattern directly to the second computer 64. There may be adopted a method in which a desk microcomputer is arranged as the first computer 63 and a cassette tape is used for delivery of the control data. The first computer 63 acts as a means for setting a pattern of change of the count number with respect to the length of a special yarn 61 to be produced and a pattern of formation of slubs. The first computer 63 is provided with a microcomputer 67 including a central processing device 65 and a memory device 66, an input device 68 such as a keyboard, an output device 69, and a tape recorder 70. The flowchart shown in FIG. 7 is written in the read-only memory (ROM) of the memory device 66. Setting of the pattern of the special yarn 61 based on this program is performed according to the following procedures. A graph in which, as shown in FIG. 8, the ratio A (%) of change of the count number to the standard count number is plotted on the ordinate and the spun length L (cm) is plotted on the abscissa is prepared and a desired pattern of the special yarn 61 is expressed by a polygonal line 71. In this case, the standard count number is designated as 0. A larger count number is expressed by a plus value, and a smaller count number is expressed by a minus value. The standard unit length La of the spun length is set at, for example, 1 cm and a maximum length Ln of the pattern is set at 70 m. Then, spun length values L0, L1, L2, . . . Ln and the count number change ratios A0, A1, A2, . . . An at the respective bending points P0, P1, P2, . . . Pn of the polygonal line 71 are determined. Moreover, slub-forming points SP1, SP2, . . . SPn are entered on the polygonal line 71, and the spun length values SL1, SL2, . . . SLn and the slub length values (time lengths for stopping rotation of the front roller 7) S1, S2, . . . Sn at the points SP1, SP2, . . . SPn are determined. Then, the program of the microcomputer 67 shown in FIG. 7 is started. When this program is started, at step (1) of "input", it is selected whether or not input of data is performed from the keyboard. When a keyboard input signal is input, the program advances to the subsequent step (2) of "initial input". At this step (2) of "initial input", the count number change ratio A0 at the starting point is input from the input device 68. Incidentally, when the count number change ratio A0 is input, the spun length L0 is set as zero. When this initial input is effected, the program advances to step (3) of "input of yarn count number data Ln, An". At this step (3), the spun length L1 and the count number change ratio A1 at the first bending point P1 on the pattern on the above-mentioned graph are input. When an input of L1 and A1 is effected, the program advances to step (4) of "discrimination of termination". If there is no input of a termination signal at step (4), the program returns to step (3) of "input of Ln and An" and the spun length L2 and count number change ratio A2 at the second bending point P2 are input. When the above procedure is repeated and input of the spun lengths L1 through Ln and count number change ratios A1 through An at all the bending points P1 through Pn is terminated, a termination signal is input at step (4) of "discrimination of termination". When this termination signal is input, the program advances to step (5) of "input of slub data SLn and Sn". At this step (5), the spun length SL1 and slub length S1 at the first slub-forming point SP1 of the pattern on the above-mentioned graph are input. When SL1 and S1 are input, the program advances to step (6) of "discrimination of termination", and if there is no input of a termination signal at step (6), the program returns to step (5) of "input of SLn and Sn", and spun length SL2 and slub length S2 at the second slub-forming point SP2 are input. When the above procedure is repeated and spun lengths SL1 through SLn and slub lengths S1 through Sn at all the slub-forming points SP1 through SP2 are input, a termination signal is input at step (6) of "discrimination of termination". Data L1 through Ln, A1 through An, SL1 through SLn, and S1 through Sn input according to the above-mentioned procedures are stored in the random access memory (RAM) of the memory device 66 of the microcomputer 67. When the above-mentioned termination signal is input, the program advances to step (7) of "operation selection". At this step (7) of "operation selection", various operations such as "transfer of data", "confirmation of data", "writing in tape", and "calculation of average thickness" can be selected. If "transfer of data" is selected at this step (7) of "operation selection", for example, where the output device 69 is connected to the second computer 64, the central processing device 65 of the microcomputer 67 calculates count number change ratios with every standard unit length La (for example, 1 cm) of the spun length based on the count number change data L0 through Ln and A0 through An. These count number change ratios are sequentially output from the output device 69 and sequentially stored in the second computer 64. If the set length Ln of the pattern of the special yarn 61 is, for example, 70 m, control data of count number change ratios at 7000 points (7001 points when repeat is not continuous) on the special yarn 61 to 70 m at intervals of the standard unit length La (1 cm) are calculated and output, and 7000 control data concerning the change of the count number are stored in the second computer 64. Furthermore, by selection of "transfer of data", control data SL1 through SLn and S1 through Sn concerning formation of slubs, stored in the memory device 66, are output and stored in the second computer 64. Data SL1 through SLn for formation of slubs, as well as count number data A1 through An for every standard unit length La, are stored according to a signal indicating the presence or absence of formation of slubs. Thus, setting of the pattern of the special yarn to be produced is completed. Where it is desired to store and hold in a cassette tape data L1 through Ln and A1 through An concerning the change of the count number and data SL1 through SLn and S1 through Sn concerning formation of slubs, stored in the memory device 66, the item "writing in tape" is selected at step (7). By this selection, the respective data stored in the memory device 66 are written in a cassette tape of the tape recorder 70. If the data written in the cassette tape is needed again, the cassette tape is set at the tape recorder 70, a tape recorder input signal is input at step (1) of "input" of the program, the program advances to step (8) of "reading of data from cassette tape", the data of the cassette tape is stored in the memory device 66 again. As is apparent from the foregoing description, various patterns of the special yarn 61 can be easily set in a short time by input of the desired data from the input device 68. Various different pattern data can be stored and held in cassette tapes (discs can also be used), and change of the pattern of a special yarn to be produced can be accomplished in a very short time.

Figure 9:
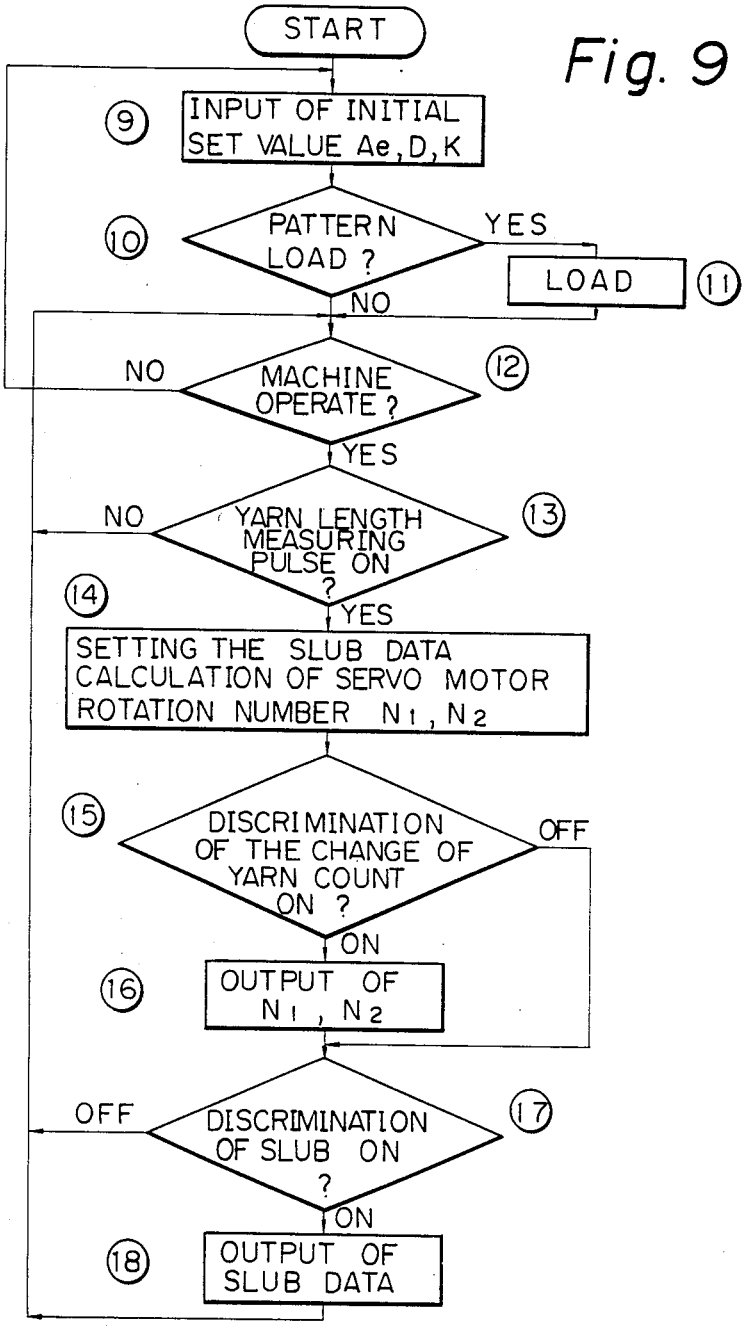
FIG. 9 is a flow chart of a procedure for producing the special yarn in accordance with the apparatus of FIGS. 1 and 2.
Figure 10:
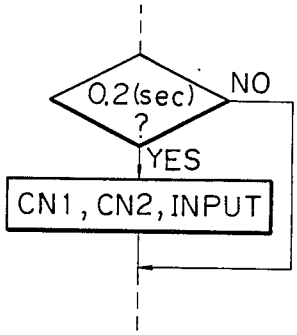
FIG. 10 is a flow chart of an interruption operation of the flow chart of FIG. 9.

The second computer 64 is a computer unit arranged for the corresponding machine frame. As shown in FIG. 6, the second computer 64 includes a microcomputer 74 including a central processing device 72 and a memory device 74, an input device 75, an output device 76, an operation panel 77, a machine frame control device 78, a first motor control device 79 for controlling the operation of the first servo motor 29, a second motor control device 80 for controlling the operation of the second servo motor 43, and a clutch control device 81. The RAM of the memory device 73 acts as memory means for storing control data of the pattern set by the first computer 63, and the control data input from the first computer 63 is sequentially stored in the RAM of the memory device 73. The main program of the flow chart shown in FIG. 9 and the spin program of the flow chart shown in FIG. 10 are written in the ROM of the memory device 73. The main program and spin program are started by turning on a start switch of the operation panel 77 after starting the spinning operation in the spinning frame. This spin program is for input of a detection value CN1 of the first pulser 56 and a detection value CN2 of the second pulser 57, and for writing these values in the RAM of the memory device 73. In the program shown in the drawings, the interruption operation is performed at intervals of 0.2 second, and the detection values CN1 and CN2 at every interruption point are input and stored anew in the RAM of the memory device 73.

The operation of the driving device 3 based on the main program will now be described. At first, by rotating the main motor 4, the driving shaft 5 is rotated in the direction indicated by an arrow to rotate each spindle 1. The rotation of the driving shaft 5 is transmitted to the front roller 7 through the first transmission mechanism 15, the first differential gear 30 of the first speed change device 11, and the second transmission mechanism 19, to rotate the front roller 7 in the direction indicated by an arrow. Furthermore, the rotation of the output gear 16 of the first differential gear 30 in the direction indicated by an arrow is transmitted to the back roller 9 through the third transmission mechanism 23, the second differential gear 44 of the second speed change gear 21, and the fourth transmission mechanism 27, to rotate the back roller 9 in the direction indicated by an arrow. The rotation of the back roller 9 is transmitted to the second roller 8 through the gear line 28 to rotate the second roller 8 in the direction indicated by an arrow. The rotation number ratio between the front roller 7 and the back roller 9 is set so that when rotation of the second servo motor 43 is stopped, a predetermined draft is given to a roving and a spun yarn of the standard count number is spun. By normal and reverse rotations of the second servo motor 43, the rotation number ratio between the front roller 7 and the back roller 9 is changed to change the count number (thickness) of the spun yarn. The rotation number ratio between the front roller 7 and the spindle 1 is adjusted so that a set twist number (for example, the twist number giving a twist coefficient of 3 to 5) suitable for the count number of the spun yarn is given to the spun yarn, and by normal and reverse rotations of the first servo motor 29, the rotation number ratio between the front roller 7 and the spindle 1 is changed to change the twist number of the spun yarn. When the main program is started where the spun yarn is spun by driving the main motor 4, the program advances to step (9) of "input of initial set value". At this step (9), the standard count number Ae, standard draft D, and twist coefficient K of the spun yarn are input. As in the conventional spinning frame, values of the standard count number Ae and standard draft D are set by exchange of change gears and the like, and the twist coefficient K is set at a value suitable for the set standard count number Ae. When the values Ae, D, and K are input, the program advances to step (10) of "pattern load". When there is an input of a pattern load signal, the program advances to step (11) of "load". If there is no input of a pattern load signal, the program advances directly to the subsequent step (12) of "discrimination of operation of machine frame". If the machine frame is under operation, the program advances to step (13) of "discrimination of length measuring pulse". When at this step (13) a length measuring pulse is emitted from the second pulser 57 (length-measuring device), the program advances to step (14) of "setting of slub data and calculation of rotation number of servo motor". The length measuring pulse is emitted every time the spun yarn is spun by the standard unit length La (for example, 1 cm). At this step (14), the presence or absence (ON or OFF) of data of the formation of slubs at the position of the spun length measured by the length measuring pulse is set at the central processing device 72, and the rotation number N1 of the first servo motor 29 and the rotation number N2 of the second servo motor 43 for controlling the change of the count number and the twist number of the spun yarn at the above-mentioned spun length position are calculated. The rotation number N2 of the second servo meter 43 is calculated based on the initial data A0 of the control data A0 through An of the change of the count number stored in the memory device 73 and the detected value of the second pulse 57 (indicating the rotation number of the front roller 7) stored by the interruption operation, so that the rotation numbers of the back roller 9 and second roller 8 are controlled to values giving the count number corresponding to the data A0 to the spun yarn. The rotation number N1 of the first servo meter 29 is calculated based on the above-mentioned data A0, the detected value of the first pulser 56 (indicating the rotation number of the spindle 1) and the preset twist coefficient K, so that the rotation number of the front roller 7 is controlled to adjust the twist coefficient of the spun yarn to the preset value K. When these calculations are terminated, the program advances to step (15) of "discrimination of change of count number". Since a signal for requiring the change of the count number is input at this step (15) (in the case of producing a structure yarn, a snap switch for discrimination of change of count number is switched on when the ring frame is operated), the program advances to step (16) of "output of N1 and N2", and the control values N1 and N2 calculated at the above-mentioned step (15) are output to the first motor control device 79 and second motor control device 80. Thus, the first motor control device 79 controls the rotation of the first servo motor to control the rotation number of the front roller 7 so that the twist number of the spun yarn corresponds to the set twist coefficient K, and the second motor control device 80 controls the second servo motor 43 to control the rotation number of the back roller 9 so that the count number of the spun yarn corresponds to the control data A0.

Then, the program advances to step (17) of "discrimination of slubs". When a slub-requiring signal is input at this step (17), the program advances to step (18) of "output of slub data". At this step (18), the presence or absence of the data of the formation of slubs set at the above-mentioned step (14) and the slub length data S0 are output in the clutch control device 81. When data of the formation of slubs is present, the clutch control device 81 temporarily de-energizes the electromagnetic clutch 59 to stop or reduce the rotation of the front roller 7 and form a slub on the spun yarn. Since a slub is not formed at the spinning starting position in the pattern shown in FIG. 8, there is no data of the formation of slubs when the first length measuring pulse is emitted, and the electromagnetic clutch 59 is not de-energized. Incidentally, when the electromagnetic clutch 59 is temporarily de-energized by the clutch control device 81 to stop the rotation of the front roller 7 and form the slub, the length measuring pulse emitted from the second pulser 57 is not used as a length measuring signal for emitting the signal for requiring the change of the count number, but as a length measuring signal for controlling the size of the slub. Then, the program returns to step (12) of "discrimination of operation of machine frame". The above operation is repeated every time the length measuring pulse is emitted. Accordingly, the count number of the spun yarn and the presence or absence of formation of slubs are controlled by every standard unit length La, and a special yarn having a pattern preset by the pattern setting means is formed. One or both of the requisite signals at step (15) of "discrimination of change of count number" and step (17) of "discrimination of slubs" are selected by a selection switch attached to the operation panel 77. The above-mentioned pattern is repeated by the continuous spinning to produce a special yarn having a predetermined length.

In the foregoing embodiment, the pattern setting means is constructed by the first computer 63. The pattern setting means can also be constructed by the second computer 64 by increasing the storing capacity of the memory device 73 of the second computer 64. Furthermore, each of the first and second speed change device 11 and 21 may be constructed by another mechanism not including a differential gear as shown in the drawings, and the first and second speed-variable motors may be constructed by motors other than the above-mentioned servo motors.

Further, the rotation number of the front roller 7 can also be detected by calculation from the detected value of the first pulser 56 and the rotation number N1 of the first servo motor 29 by means of the second computer 64, so that the second pulser 57 is eliminated. Or, the rotation number of the spindle 1 can be detected by calculation from the detected value of the second pulser 57 and the rotation number Ne by means of the second computer 64, so that the first pulser 56 is eliminated.

As is apparent from the foregoing description, the first speed change device utilizing the first speed-variable motor is arranged in the transmission system between the spindle and front roller and the second speed change device utilizing the second speed-variable motor is arranged in the transmission system between the front roller and back roller. The second speed-variable motor is controlled based on the control data of the preset pattern of the special yarn to change the count number of the spun yarn according to the preset pattern and the first speed-variable motor is controlled based on the above-mentioned control data to change the twist number of the spun yarn according to the controlled count number. Accordingly, by presetting a pattern of a special yarn to be produced, desired changes of the count number can be given to one spun yarn and the twist number can be changed according to the changes of the count number so that a desired twist coefficient is given to this spun yarn, whereby a practical special yarn in which the count number is optionally changed to give a unique touch can be produced according to the present embodiment. Moreover, since the apparatus of the present embodiment includes pattern setting means for setting a pattern of change of the count number with respect to the length of the special yarn and memory means for storing control data indicating the set pattern, and the first speed-variable motor and second speed-variable motor are controlled based on the control data stored in the memory means, various special yarns of varied patterns can be produced by setting various special yarn patterns in the memory means and exchange of special yarn patterns can be easily accomplished in a short time. Therefore, the apparatus of the present embodiment is very effective as the special yarn-producing apparatus for small lot production. Furthermore, since special yarns are prepared by electrically controlling the speed of the roller in the drafting zone, the present invention can be applied to an existing spinning frame at a small remodeling cost. This is another advantage attained by the present embodiment.

A first main embodiment where the yarn forming device is a rotating rotor, and the yarn count number and the twist number are adopted as the yarn constructive parameters will now be described.

In an open end spinning frame, fiber bundles fed by a feed roller are separated into individual fibers, then the fibers are collected on an inside circumferential surface of a rotating rotor. The collected fibers are twisted by rotation of the rotating rotor, withdrawn by a delivery roller, and wound on a bobbin by a winding unit.

Figure 12:
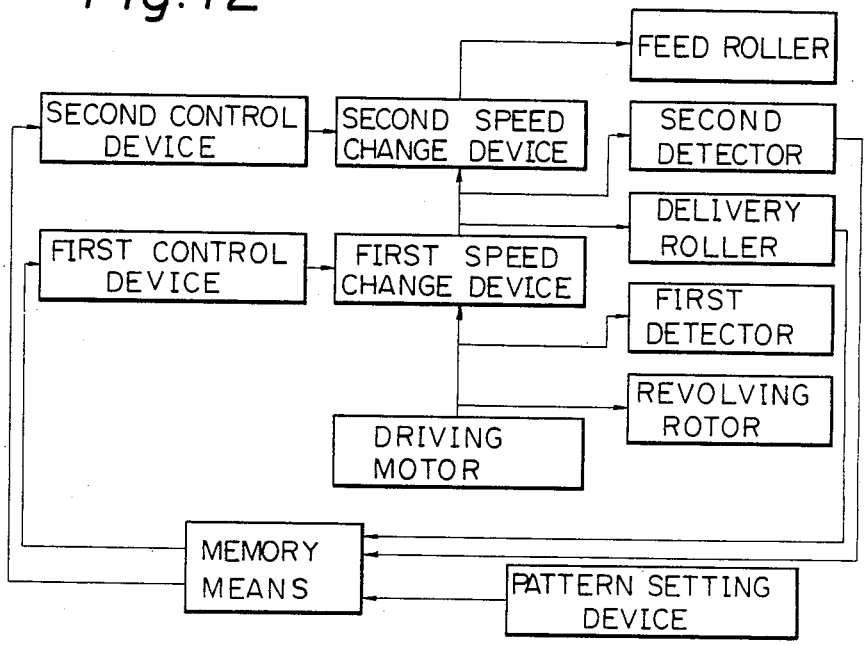
FIG. 12 is an explanatory view of the construction of the apparatus of FIG. 11.

The apparatus of the second embodiment, illustrated in FIG. 12 includes a first speed change device which is arranged in a driving system between a rotating rotor and a delivery roller and can change the relative speed of rotation between the rotating rotor and the delivery roller; a second speed change device which is arranged in a driving system between the delivery roller and a feed roller and can change the relative speed of rotation between the delivery roller and the feed roller; a length measuring device which can measure the length of a spun yarn; pattern setting means for setting a pattern of change of the yarn count number with respect to the length of a special yarn to be produced; memory means for storing control data indicating the pattern set by the pattern setting means; a second control device for controlling the second speed change device with respect to a length measuring signal of the length measuring device based on control data of the memory means and changing the count number of a spun yarn according to the set pattern; and a first control device for controlling the first speed change device with respect to the length measuring signal of the length-measuring device based on control data of the memory device and changing a twist number of the spun yarn according to the count number.

Figure 11:
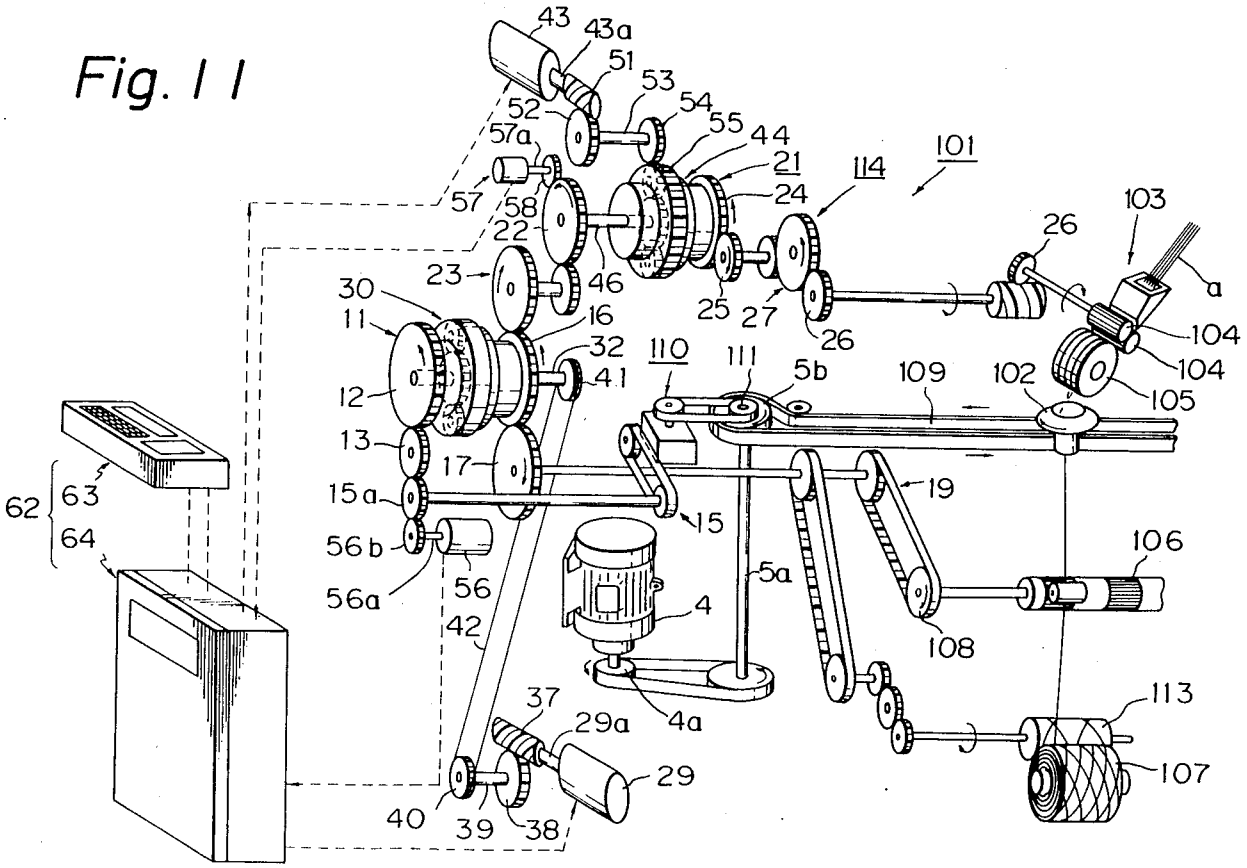
FIG. 11 is a perspective view of a main portion of the construction, especially the driving mechanism of the apparatus according to the present invention as adapted to an open end spinning frame and using the yarn count number and twist number as the yarn constructive parameters.

In this embodiment, as shown in FIG. 11, a driving system 101 in the open end type yarn producing apparatus is used as a fundamental driving system. A spinning unit 103 of the open end spinning frame includes a feed roller 104 feeding a fiber bundle (sliver) (a); a separating device 105 for separating the fiber bundle fed by the feed roller 104 to individual fibers; a rotating rotor 102 for collecting the fibers fed in the separated state onto an inside circumferential surface in a band-like state; a delivery roller 106 for twisting the fibers in the rotating rotor 102 and withdrawing the twisted fibers as the yarn; and a traverse drum 113 for winding the yarn withdrawn by the delivery roller 106 into a cheese 107. Though the separating device 105 is shown as a device utilizing a combing roller, a device utilizing air may also be used. The rotating rotor 102 is rotated at a high speed by a belt 109 driven through a shaft 5*a*, pulley 5*b*, and the like from a driving pulley 4*a* of a driving motor 4. A driving system 110 between the rotating rotor 102 and the delivery roller 106 includes a first speed change device arranged at a point midway of the driving system 110, a first transmission mechanism 15 for transmitting rotation of a pulley 111 secured to the shaft 5*a* to a gear 13 engaged with an input device 12 of the first speed change gear 11, and a second transmission mechanism 19 for transmitting rotation of a gear 17 engaged with an output gear 16 of the first speed change device 11 to a pulley 108 secured to the delivery roller 106. Incidentally, the second transmission mechanism 19 can also rotate the traverse drum 113. A driving system 114 between the delivery roller 106 and the feed roller 104 includes a second speed change device 21 arranged at a point midway of the driving system 114, a third transmission mechanism 23 for transmitting rotation of the output gear 16 of the first speed change device 11 to an input gear 22 of the second speed change device 21, a fourth transmission mechanism 27 for transmitting rotation of a gear 25 engaged with an output gear 24 of the second speed change device 21 to a gear 26 secured to the feed roller 104, and the above-mentioned second transmission mechanism 19. Incidentally, the driving system 114 between the delivery roller 106 and the feed roller 104 includes the second transmission mechanism 19 between the rotating rotor 102 and the delivery roller 107, but rotation of the pulley 108 may be transmitted to the input gear 22 by another transmission mechanism so that the driving system 114 does not include the second transmission mechanism 19.

Since this embodiment differs from the first embodiment and does not consider a structure of the special yarn having slubs, the clutch for intermittently stopping the rotation of the front roller used in the first embodiment is not needed.

Further, the first speed change device 11 includes a first differential gear 30 controlled by a first servo motor 29 arranged as the first speed-variable motor.

Further, the second speed change device 21 includes a second differential gear 44 controlled by a second servo motor 43 arranged as the second speed-variable motor. Since the construction and the function of the first differential gear 30 and the second differential gear 44 are the same as that in the first embodiment, detailed descriptions are omitted.

The length-measuring means is also an indispensable means in this embodiment. The construction and function of the length-measuring means in this embodiment are similar to those in the first embodiment. Namely, a first detector for detecting the rotation number of the rotating rotor and a second detector for detecting the rotation number of the delivery roller are used.

Reference numeral 56 represents a first pulser arranged as the first detector for detecting the rotation number of the rotating rotor 102. A gear **56*b* secured to a detection shaft 56*a* of the first pulser 56 is engaged with a gear 15*b* of the first transmission mechanism 15. Reference numeral 57 represents a second pulser arranged as the second detector for detecting the rotation number of the delivery roller 106. A gear 58 secured to a detection shaft 57*a* of the second pulser 57 is engaged with the input gear 22 of the second differential gear 44. The second pulser 57 also acts as a length-measuring means for measuring the spun length and generating a length measuring pulse as the length measuring signal. The length measuring pulse emitted from the second pulser 57 is emitted every time a spun yarn is fed by a standard unit length (for example, 1 cm) according to a set pattern, described hereinafter, by the delivery roller 106. Incidentally the length-measuring device may be arranged independently from the second pulser 57. Further the pulse emitted from the second pulser 57 may be emitted every time the spun yarn is fed by a length extremely shorter than the standard unit length of the spun yarn. A central processing device of a second computer, described hereinafter, may count the pulses emitted from the second pulser 57** and emit the length measuring signal for each standard unit length.

Figure 13:
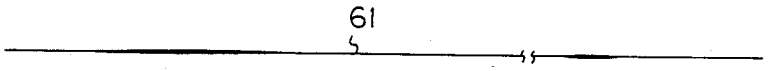
FIG. 13 is an enlarged side view of an embodiment of the special yarn produced by the apparatus of FIG. 11.
Figure 14:
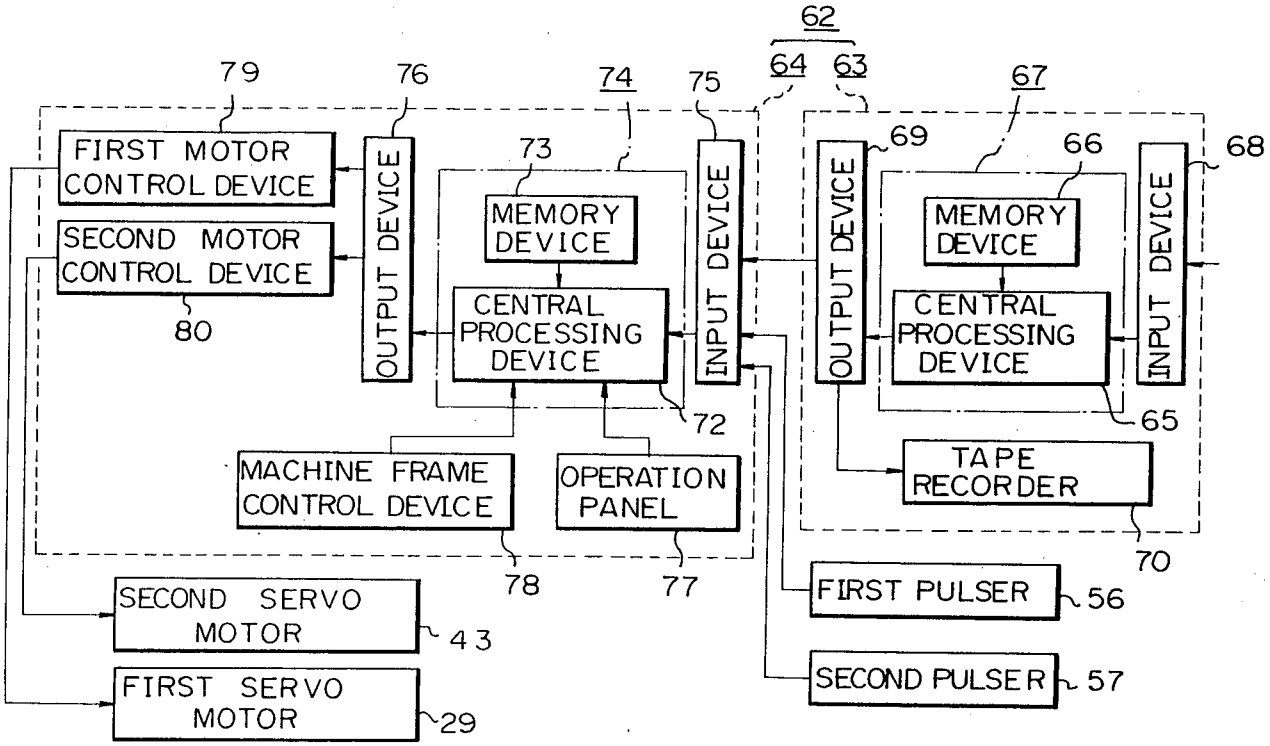
FIG. 14 is a block diagram of an electric control unit of the apparatus of FIG. 11.
Figure 15:
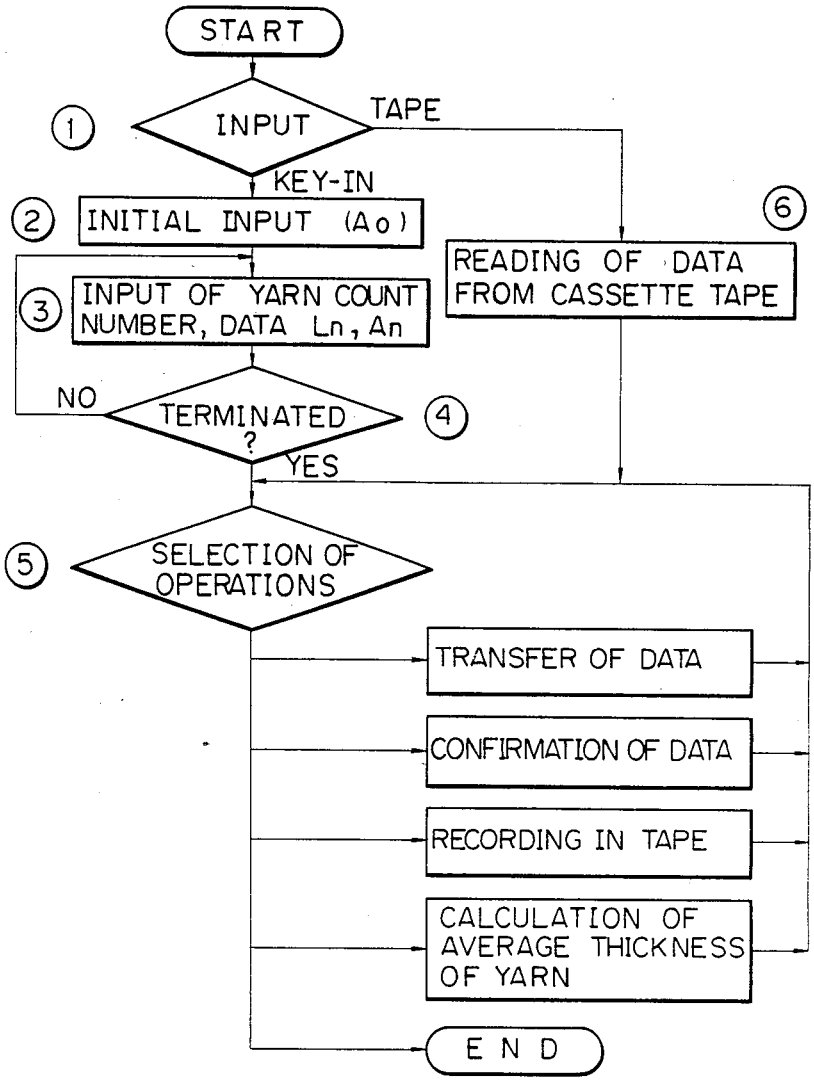
FIG. 15 is a flow chart of the procedure for setting a pattern in accordance with the electric control unit of FIG. 14.
Figure 16:
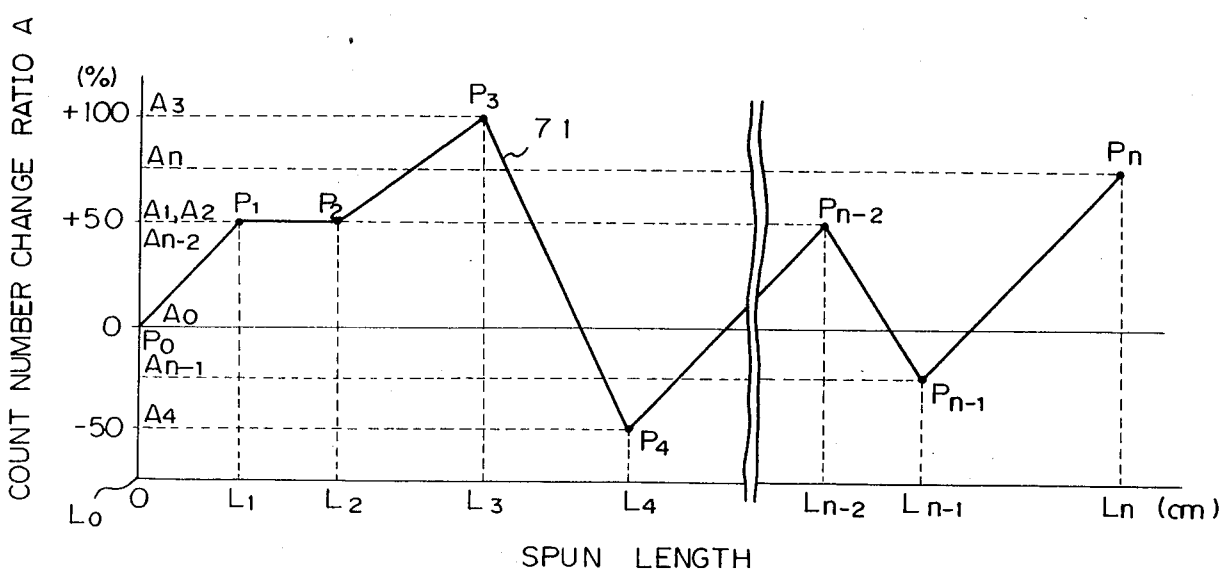
FIG. 16 is an explanatory view of an embodiment of a set pattern of special yarn produced by the apparatus of FIG. 11.

An electric control unit 62 for producing a special yarn 61 as shown in FIG. 13 by controlling operations of the first servo motor 29 and second servo motor 43 will now be described. As shown in FIGS. 12 and 14, the electric control unit 62 includes a first computer 63 for setting a pattern of the special yarn to be produced and a second computer 64 for storing control deta representing the pattern set by the first computer 63 and controlling operations of the first servo motor 29 and second servo motor 43 during spinning based on control data of the stored pattern, as in the first embodiment. The first computer 63 acts as a means for setting a pattern of change of the count number with respect to the length of a special yarn 61 to be produced. The first computer 63 is provided with a microcomputer 67 including a central processing device 65 and a memory device 66, an input device 68 such as a keyboard, an output device 69, and a tape recorder 70. The flow chart shown in FIG. 15 is written in the ROM of the memory device 66. Setting of the pattern of the special yarn 61 based on this program is performed according to the following procedures. A graph in which, as shown in FIG. 16, the ratio A (%) of change of the count number to the standard count number is plotted on the ordinate and the spun length L (cm) is plotted on the abscissa is prepared, and a desired pattern of the special yarn 61 is expressed by a polygonal line 71. In this case, the standard count number is designated as 0. A larger count number is expressed by a plus value, and a smaller count number is expressed by a minus value. The standard unit length La of the spun length is set at, for example, 1 cm and a maximum length Ln of the pattern is set at 70 m. Then, spun length values L0, L1, . . . Ln and the count number change ratios A0, A1, A2, . . . An at the respective bending points P0, P1, . . . Pn of the polygonal line 71 are determined. Then, the program of the microcomputer 67 shown in FIG. 15 is started. When this program is started, at step (1) of "input", it is selected whether or not input of data is performed from the keyboard. When a keyboard input signal is input, the program advances to the subsequent step (2) of "initial input". At this step (2) of "initial input", the count number change ratio A0 at the starting point is input from the input device 68. Incidentally, the spun length value L0 is set to zero by the input of the change ratio A0. When this initial input is effected, the program advances to step (3) of "input of count number data Ln, An". At this step (3), the spun length L1 and the count number change ratio A1 at the first bending point P1 on the pattern on the above-mentioned graph are input. When an input of L1 and A1 is effected, the program advances to step (4) of "discrimination of termination". If there is no input of a termination signal at step (4), the program returns to step (3) of "input of Ln and An" and the spun length L2 and count number change ratio A2 at the second bending point P2 are input. When the above procedure is repeated and input of the spun lengths L0 through Ln and count number change ratios A0 through An at all the bending points P0 through Pn is terminated, a termination signal is input at step (4) of "discrimination of termination". Data L1 through Ln, A1 through An, SL1 through SLn, and S1 through Sn input according to the above-mentioned procedures are stored in the RAM of the memory device 66 of the microcomputer 67. When the above-mentioned termination signal is input, the program advances to step (5) of "operation selection". Since step (5) of "operation selection" is performed in the same way as that of the above-mentioned first embodiment, a description regarding step (5) is omitted. Incidentally, the second computer 64 may perform the calculating process of the above-mentioned control data. Thus, setting of the pattern of the special yarn to be produced is completed.

The second computer 64 is a computer unit arranged for the corresponding machine frame as in the first embodiment. As shown in FIG. 14, the second computer 64 includes a microcomputer 74 including a central processing device 72 and a memory device 74, an input device 75, an output device 76, an operation panel 77, a machine frame control device 78, a first motor control device 79 for controlling the operation of the first servo motor 29, and a second motor control device 80 for controlling the operation of the second servo motor 43. The RAM of the memory device 73 is the same as the RAM in the first embodiment.

Figure 17:
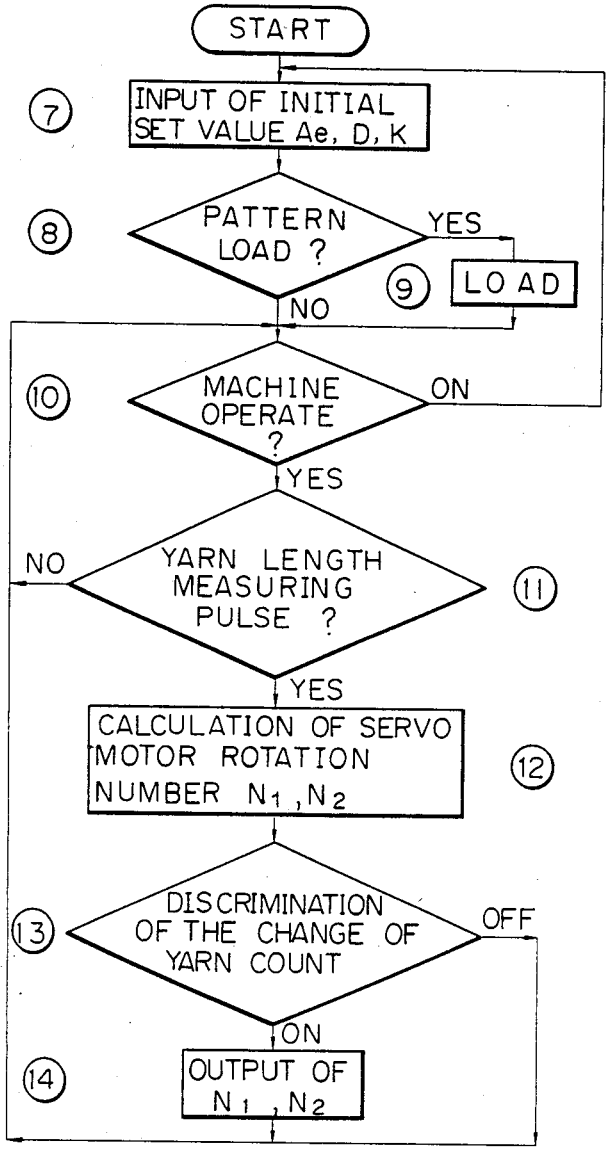
FIG. 17 is a flow chart of a procedure for producing the special yarn in accordance with the apparatus of FIG. 11.

The main program of the flow chart shown in FIG. 17 and the spin program of the flow chart shown in FIG. 10 are written in the ROM of the memory device 73 in the same way as that of the first embodiment. The main program and spin program are started by turning on a start switch of the operation panel 77 after starting the spinning operation in the spinning frame.

The operation of the driving system 101 based on the main program will now be described. At first, by rotating the main motor 4, the shaft 5*a*, the pulley 5*b*, and the belt 109 are rotated in the direction indicated by an arrow to rotate each rotating rotor 102. The rotation of the shaft 5*a* is transmitted to the delivery roller 106 through the first transmission mechanism 15, the first differential gear 30 of the first speed change device 11, and the second transmission mechanism 19, to rotate the delivery roller 106 in the direction indicated by an arrow. Furthermore, the rotation of the output gear 16 of the first differential gear 30 in the direction indicated by an arrow is transmitted to the feed roller 104 through the third transmission mechanism 23, the second differential gear 44 of the second speed change device 21, and the fourth transmission mechanism 27, to rotate the feed roller 104 in the direction indicated by arrow. The rotation number ratio between the delivery roller 106 and the feed roller 104 is set so that when rotation of the second servo motor 43 is stopped, the yarn having the standard count number is spun from the rotating rotor 102. By normal and reverse rotations of the second servo motor 43, the rotation number ratio between the delivery roller 106 and the feed roller 104 is changed to change the count number (thickness) of the spun yarn. The speed ratio between the delivery roller 106 and the rotating rotor 102 is adjusted so that a set twist number (for example, the twist number giving a twist coefficient of 3 to 5) suitable for the count number of the spun yarn is given to the spun yarn. By normal and reverse rotations of the first servo motor 29, the rotation number ratio between the delivery roller 106 and the rotating rotor 102 is changed to change the twist number of the spun yarn. When the main program is started where the spun yarn is spun by driving the driving motor 4, the program advances to step (7) of "input of initial set value". At this step (7), the standard count number Ae, standard draft D, and twist coefficient K of the spun yarn are input. When the values Ae, D, and K are input, the program advances to step (8) of "pattern load". When there is an input of a pattern load signal, the program advances to step (9) of "pattern load". If there is no input of a pattern load signal, the program advances directly to the subsequent step (10) of "discrimination of operation of machine frame". If the machine frame is under operation, the program advances to step (11) of "discrimination of length measuring pulse". When at this step (11) a length measuring pulse is emitted from the second pulser 57 (length-measuring means), the program advances to step (12) of "calculation of rotation number of servo motor". The length measuring pulse is emitted every time the spun yarn is spun by the standard unit length La (for example, 1 cm). At this step (12), the rotation number N1 of the first servo motor 29 and the rotation number N2 of the second servo motor 43 for controlling the change of the count number and the twist number of the spun yarn at the position of the spun length measured by the length measuring pulse are calculated. The rotation number N2 of the second servo motor 43 is calculated based on the initial data A0 of the control data A0 through An of the change of the count number stored in the memory device 73 and the detected value of the second pulse 57 (indicated the speed for delivery roller 106) stored by the interruption operation, so that the rotation numbers of the feed roller 104 are controlled to values giving the count number corresponding to the data A0 to the spun yarn. The rotation number N1 of the first servo motor 29 is calculated based on the above-mentioned data A0, the detected value of the first pulser 56 (indicating the rotation number of the rotating rotor 102) and the preset twist coefficient K, so that the rotation number of the delivery roller 106 is controlled to adjust the twist coefficient of the spun yarn to the preset value K. When these calculations are terminated, the program advances to step (13) of "discrimination of change of count number", and when a signal for requiring the change of the count number is input at this step (13) (in the case of producing the special yarn, a snap switch for discrimination of change of the count number is switched on when the spinning frame is operated), the program advances to step (14) of "output of N1 and N2", and the control values N1 and N2 calculated at the above-mentioned step (12) are output to the first motor control device 79 and second motor control device 80. Thus, the first motor control device 79 controls the rotation of the first servo motor to control the rotation number of the delivery roller 106 so that the twist number of the spun yarn correspondly to the set twist coefficient K, and the second motor control device 80 controls the second servo motor 43 to control the rotation number of the feed roller 104 so that the count number of the spun yarn corresponds to the control data A0. A required signal in the step (13) of "discrimination of change of count number" is selected by a selection switch attached to the operation panel 77.

Then, the program advances to step (10) of "discrimination of operation of machine frame" and the above operation is repeated. Accordingly, the rotation of the second servo motor 43 and the first servo motor 29 are controlled so that the count number and the twist number at the position of spun length corresponding to the length measuring pulse become the pattern set value every time the length measuring pulse is emitted from the second pulser 57. When the speed of the feed roller 104 is increased by the rotation control of the second servo motor 43, the quantity of the fibers fed to the rotating roller 102 is increased, then the count number of the spun yarn withdrawn by the delivery roller 106 is increased. While, when the speed of the feed roller 104 is decreased, the count number of the spun yarn becomes small. Further, the speed of the delivery roller 106 is increased by the rotation control of the first servo motor 29, and the twist number of spun yarn becomes small, while when the speed of the delivery roller 106 is decreased, the twist number of spun yarn becomes large. Accordingly, a special yarn having the pattern set by the pattern setting mean can be obtained by repeating the above-mentioned operations. Further, the special yarn having the desired length can be easily produced by continuously repeating the production of the special yarn having the above-mentioned pattern.

Figure 18:
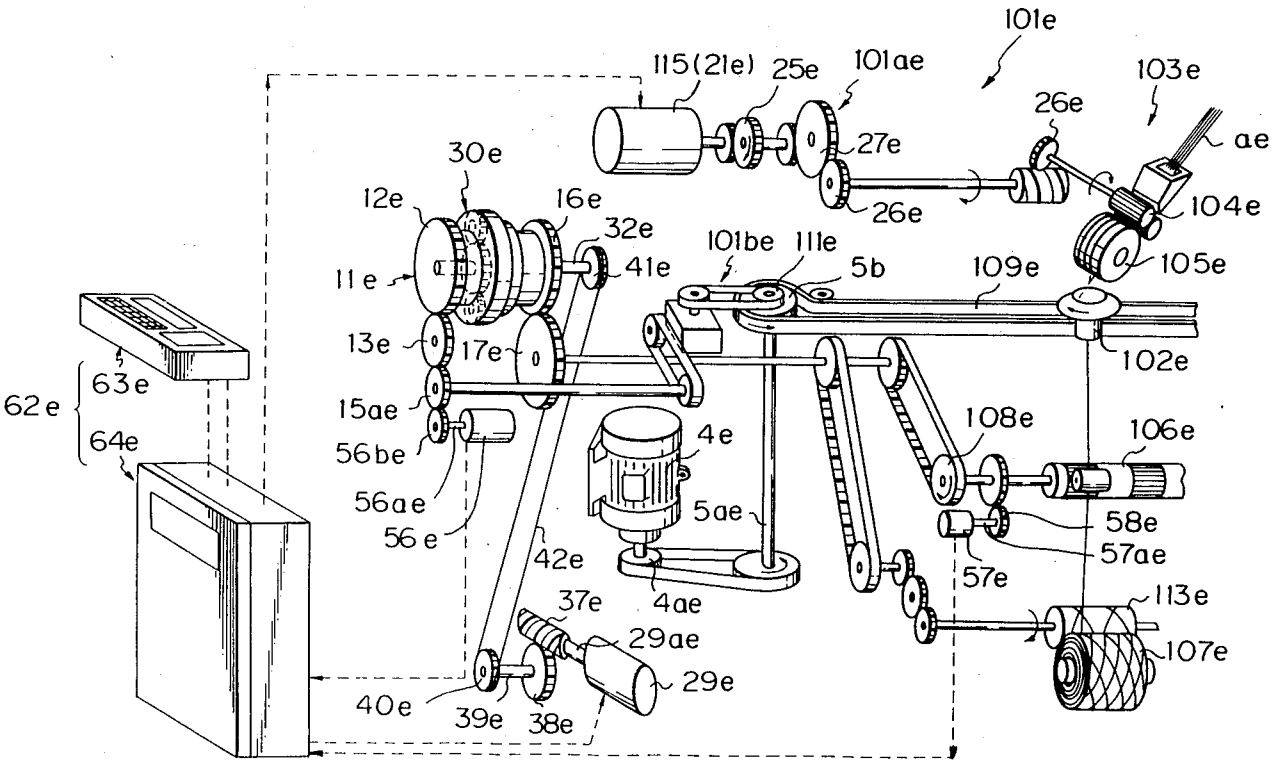
FIGS. 18 and 19 are perspective views of modifications of the apparatus of FIG. 11, illustrating different driving systems.

FIG. 18 illustrates a modification of FIG. 11. In this embodiment, a driving system 101*e* including a feed roller 104*c*, a delivery roller 106*e*, and a rotating rotor 102*e* is divided into a first driving system 101*ae* for rotating the feed roller 104*e* by a first driving motor 115 and a second driving system 101*be* for rotating the delivery roller 106*e* and the rotating roller 102*e* by a second driving motor 4*e*. The second speed change device 21*e* consists of the first driving motor 115 by using a speed-variable motor as the first driving motor 115. Further, as in the embodiment illustrated in FIG. 11, a first speed change gear ll*e* is arranged between the delivery roller 106*e* and the rotating rotor 102*e* of the second driving system 101*be*. In this embodiment, change of the count number of the spun yarn is performed by controlling the speed of the first driving motor 115, the speed of the delivery roller 106*e* is controlled by controlling the speed of the first servo motor 29*e* in the first speed change device l*le*, and the twist number of the spun yarn is controlled to a value corresponding to the count number of the spun yarn. Incidentally, elements in this embodiment having the same or equivalent constructions as elements of the embodiment of FIG. 11 are given the same numeral with the suffix "e". Detailed descriptions regarding the above-mentioned elements will be omitted.

Figure 19:
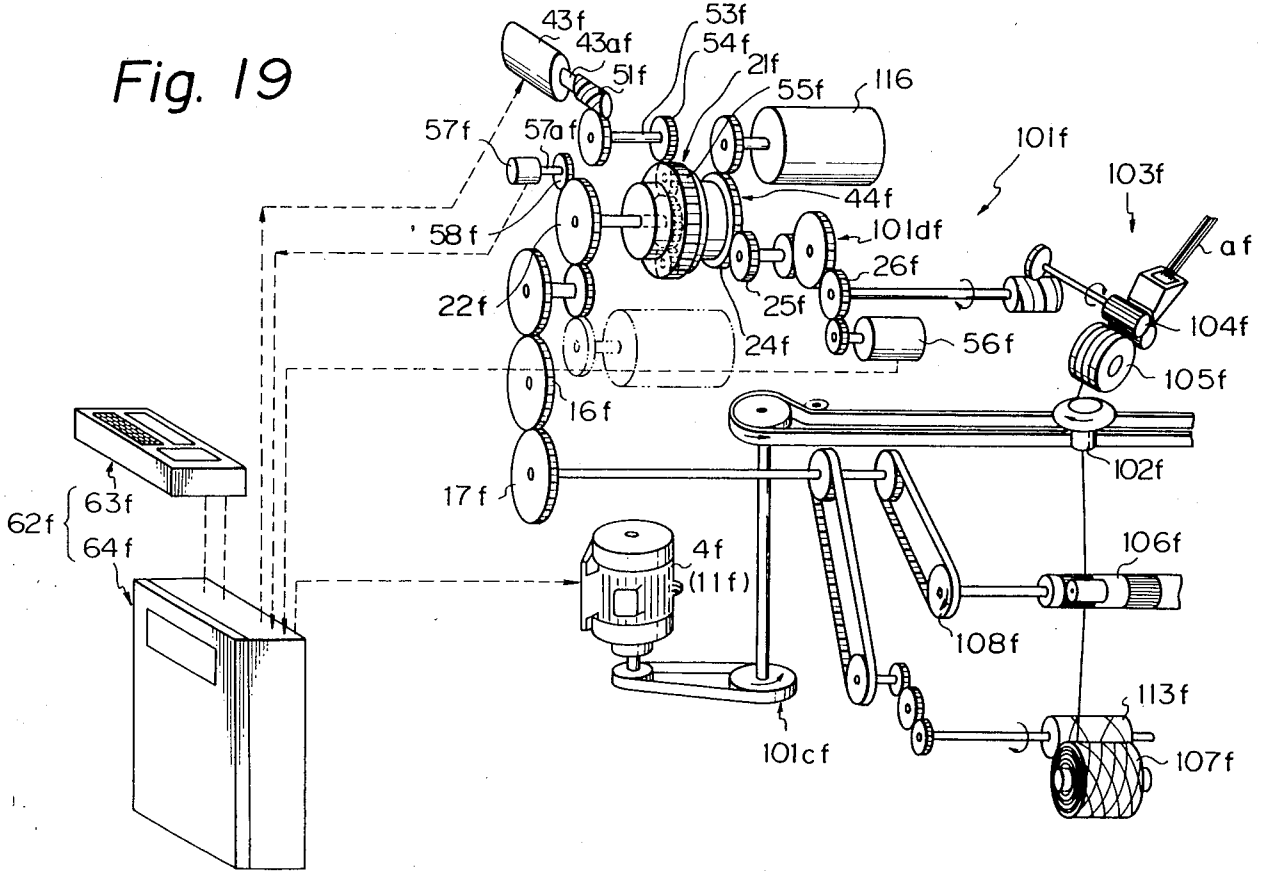

FIG. 19 illustrates another modification of the embodiments of FIGS. 11 and 18. In this embodiment, elements having the same or equivalent constructions as elements of the embodiments of FIGS. 11 and 18 are given the same numeral with the suffix "f". Detailed descriptions regarding the above-mentioned elements will be omitted.

In the embodiment illustrated in FIG. 19, a driving system 101*f* including a feed roller 104*f*, a delivery roller 106*f*, and a rotating rotor 102*f* is divided into a third driving system 101*cf* for rotating the rotating rotor 102*f* by a third driving motor 4*f* and a fourth driving system 101*df* for rotating the feed roller 104*f* and the delivery roller 106*f* by a fourth driving motor 116. The first speed change device 11*f* consists of the third driving motor 4*f* by using a speed-variable motor as the third driving motor 4*f*. Further, a second speed change device 21*f* is arranged between the feed roller 104*f* and the delivery roller 106*f* of the fourth driving system 101*df*. In this embodiment, the speed of the delivery roller 106*f* is controlled by controlling the speed of the second servo motor 43*f* in the second speed change device 21*f* to change the count number of the spun yarn, and a twist number of the spun yarn is controlled to a value corresponding to the count number of the spun yarn by controlling the speed of the third driving motor 4*f*.

Incidentally, as shown in the imaginary lines of FIG. 19, the fourth driving motor 116 may be displaced from the differential gear 44*f* to the delivery roller 106*f*, and the speed of the feed roller 104*f* may be controlled by controlling the speed of the second servo motor 43*f*, so that the count number of the spun yarn may be changed. Further, the feed roller 104*f* and the delivery roller 106*f* may be independently driven by different motors. At least one of the above motors may be constructed as a speed-variable motor and the second speed change device 21*f* may be constructed by the above variable motor.

As apparent from the foregoing description, with regard to this embodiment for the open end spinning frame, the first speed change device is arranged in the driving system of the rotating rotor and the delivery roller to change the relative speed between the rotating rotor and the delivery roller. The second speed change device is arranged in the driving system of the delivery roller and the feed roller to change the relative speed between the delivery roller and the feed roller. The second speed change device is controlled based on the control data of the preset pattern of the special yarn to change the count number of the spun yarn according to the preset pattern, and the first speed change device is controlled based on the above-mentioned control data to change the twist number of the spun yarn to the controlled count number. Accordingly, by presetting a pattern of a special yarn to be produced, desired changes of the count number can be given to one spun yarn and the twist number can be changed according to the changes of the count number so that a desired twist coefficient is given to this spun yarn, whereby a practical special yarn in which the count number is optionally changed to give a unique touch can be produced.

An embodiment using a fasciated yarn spinning frame, in which fiber strands fed out from a front roller of a draft unit are fed to an air jet nozzle to form yarn, and using the yarn count number as the yarn constructive parameter variable in the lengthwise direction of the yarn will now be described.

The fasciated yarn spinning frame is constructed such that a fiber bundle drafted in a draft zone is fed to the air nozzle, the fiber bundle is given a false twist in the air nozzle and spun to a yarn, and the yarn is wound by a winding unit.

Figure 20:
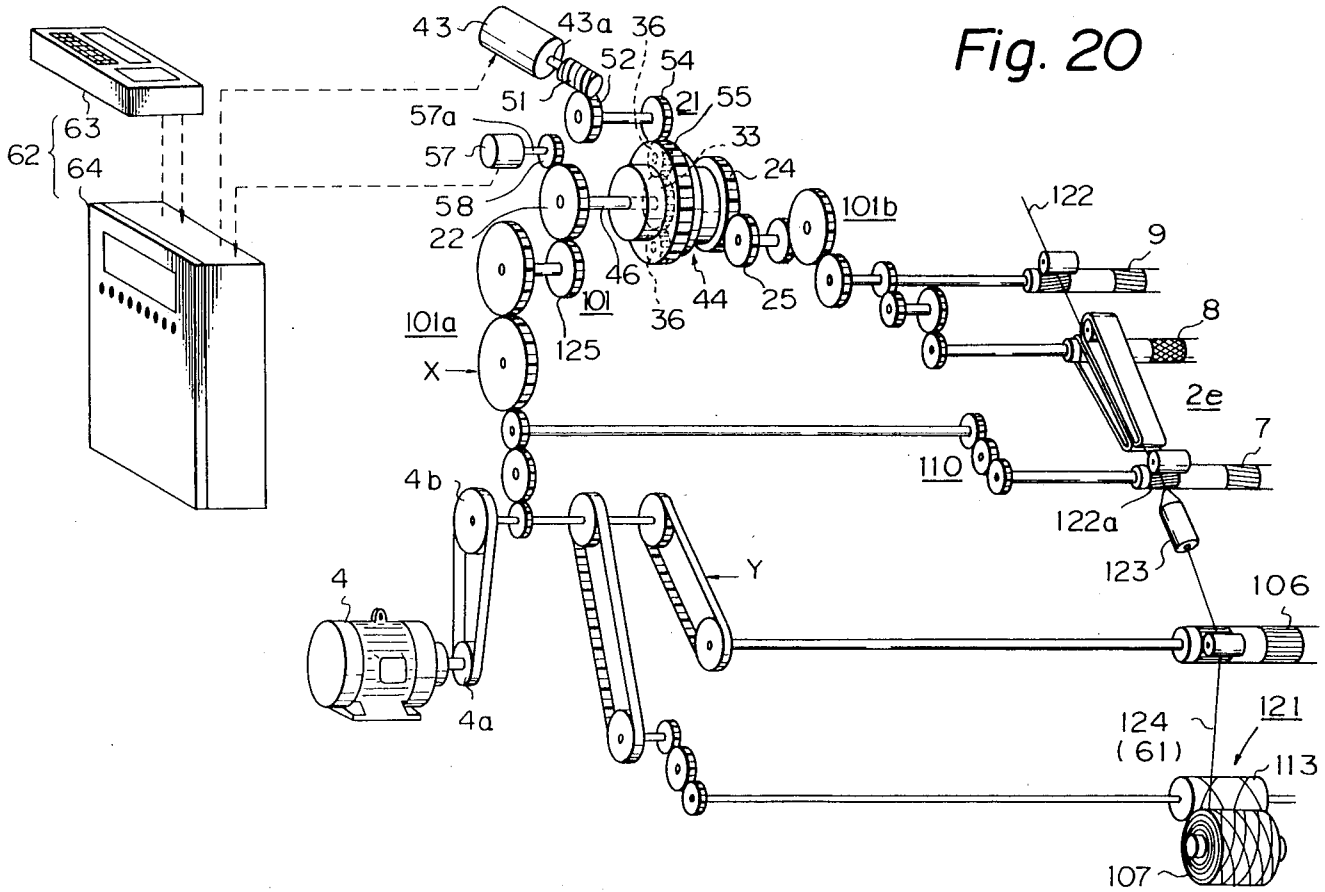
FIG. 20 is a perspective view of the main portion of the construction, especially the driving mechanism, of the apparatus according to the present invention as adapted to a fasciated yarn spinning machine and using the yarn count number as the yarn constructive parameter.
Figure 21:
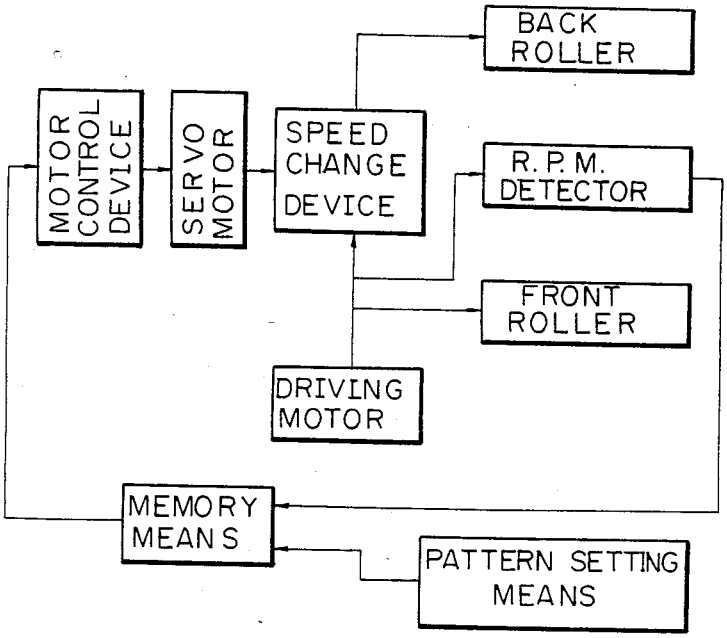
FIG. 21 is an explanatory view of the construction of the apparatus of FIG. 20.

An apparatus of the above third embodiment, illustrated in FIG. 20, includes a speed change device arranged on a driving system of the draft zone to change the relative speed between a back roller and a front roller, a length-measuring means which can measure a length of a spun yarn; pattern setting means for setting a pattern of change of the count number with respect to the length of a special yarn to be produced; memory means for storing therein control data indicating the pattern set by the pattern setting means; and a control device for controlling the speed change device with respect to a length-measuring signal of the length-measuring means based on control data of the memory means and changing the count number of the spun yarn according to the set pattern.

Figure 25:
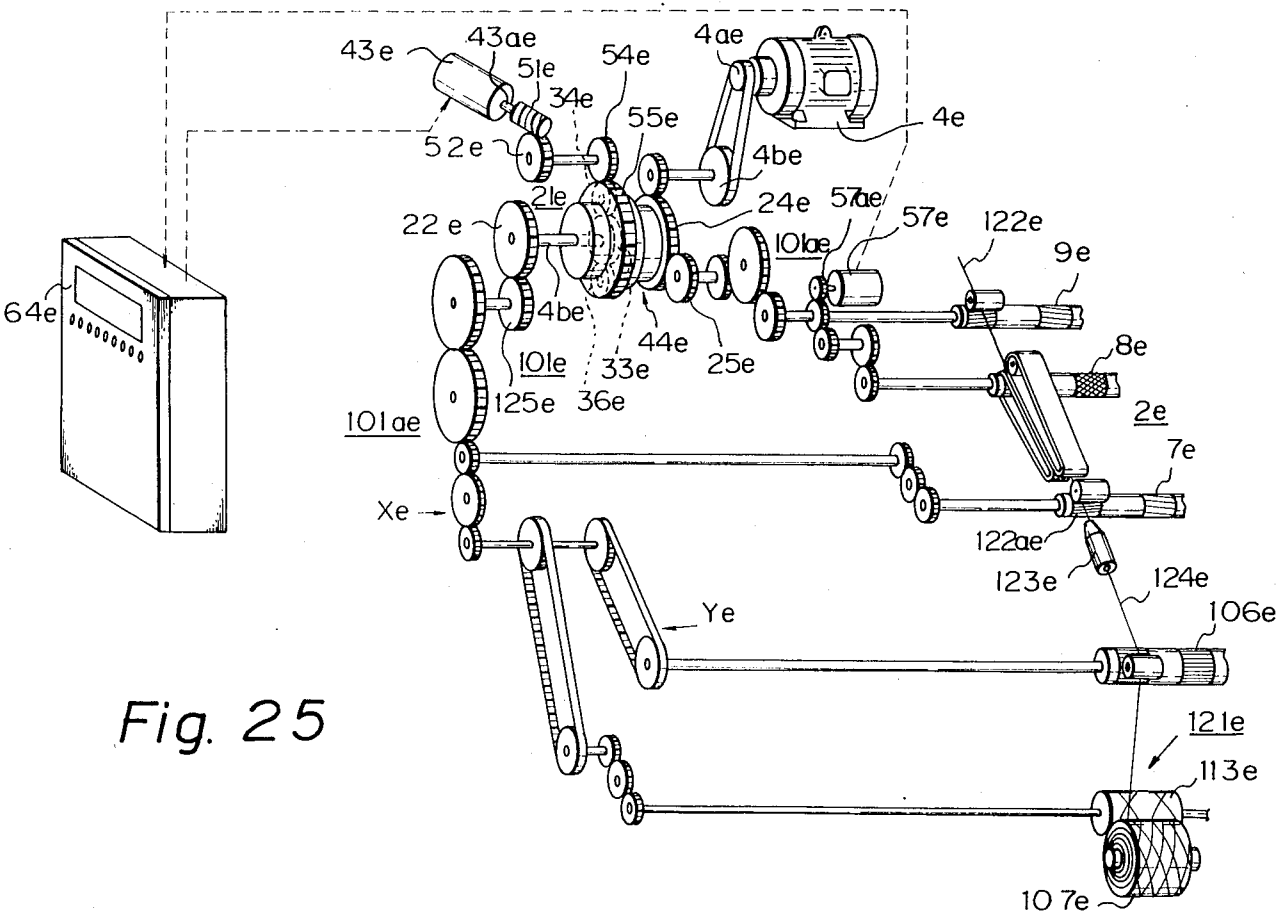
FIGS. 25 and 26 are perspective views of modifications of the apparatus of FIG. 20, illustrating different driving systems.
Figure 26:
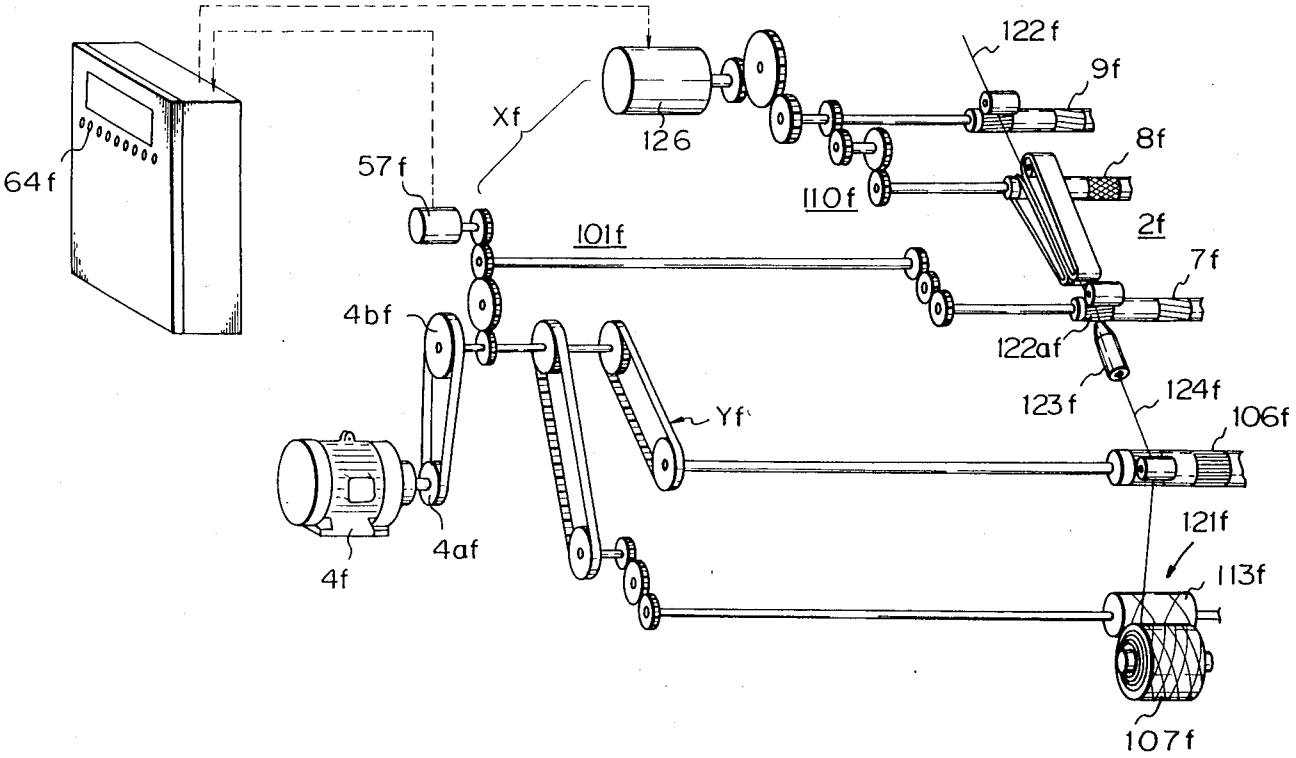

Further, modifications of the embodiment illustrated in FIG. 20 are used in practice, e.g., as apparatuses illustrated in FIGS. 25 and 26. In the apparatuses illustrated in FIGS. 20 and 25, all driving systems are driven by a single driving motor and a speed change device is provided. In the apparatus illustrated in FIG. 26, the driving system of the draft zone is divided into two driving systems each rotated by its own driving motor, and the speed change device is arranged at a predetermined position of the divided driving system.

First, the apparatus of FIG. 20 will be described. In this embodiment, a driving system X for the draft zone 2 and a driving system Y for a winding unit 121 and a delivery roller 106 are driven by a single driving motor 4. The winding unit 121 includes a traverse drum 108. A sliver 122 is drafted in the draft zone 2 by rotation of the driving motor 4 to become a fiber bundle 122*a*. The fiber bundle 122*a* is fed to a nozzle 123 and is given a false twist. A spun yarn 124 withdrawn by the delivery roller 106 is wound to a cheese 107 in contact with the traverse roller 113. The above-mentioned driving system X is divided into a first driving system 101 from the driving motor 4 to a back roller 9 (a second roller 8 is rotated in cooperation with the back roller 9) and a second driving system 110 for driving a front roller 7. A speed change device 21 including a differential gear 44 and a servo motor 43 is provided in the first driving system 101. The first driving system 101 is divided into a first transmission system 101*a* from the driving motor 4 to a gear 125 engaged with an input gear 22 secured to a main shaft 46 of the differential gear 44 and a second transmission system 101*b* from the gear 125 engaged with an output gear 24 of the differential gear 44 by the speed change device 21. A worm 51 secured to a shaft 43*a* of the servo motor 43 is engaged with a worm wheel 52, and a gear 54 arranged on an end of the worm wheel 52 is engaged with a gear 44 of a differential gear 55, so that rotation of the servo motor 43 is input to an input gear 22 of the differential gear 44. Since the construction and function of the differential gear 44 are the same as the differential gear 21 of the first embodiment, a description regarding the differential gear 44 will be omitted.

As in the first embodiment, reference 36 is a pulser arranged as a rotation detector which detects a rotation number (rotation speed) of the front roller 7. The pulser 36 includes a length-measuring means which measures a spun length and emits a length-measuring pulse as a length measuring signal.

Figure 22:
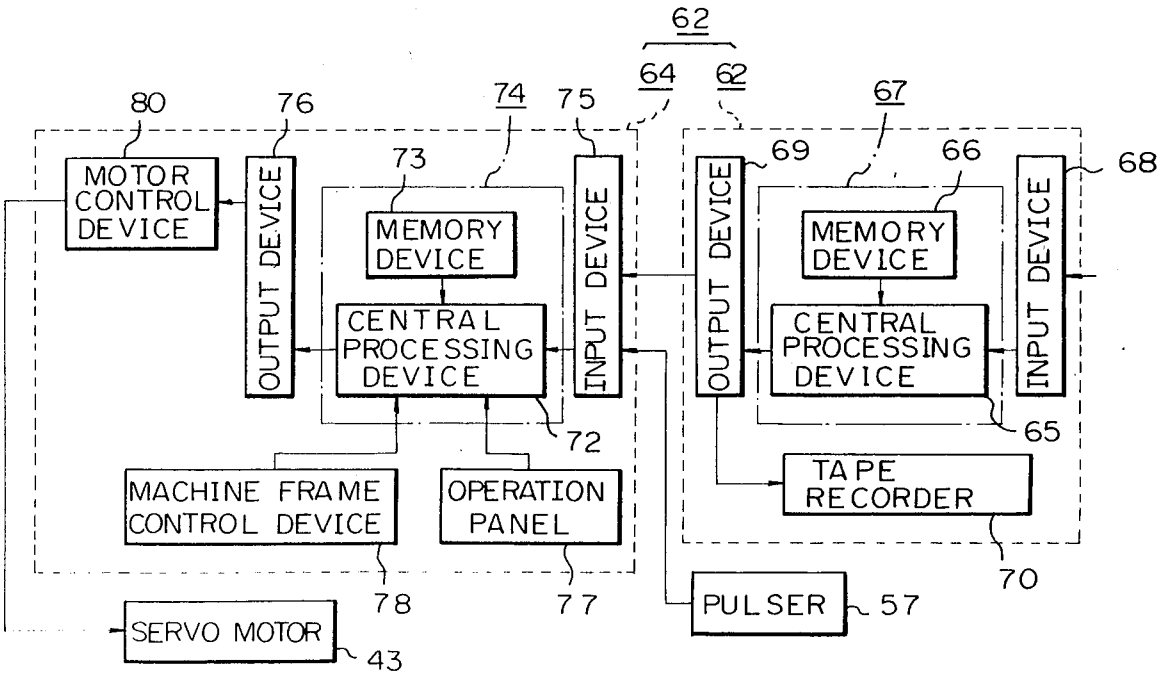
FIG. 22 is a block diagram of an electric control unit of the apparatus of FIG. 20.

An electric control unit for controlling the operation of the servo motor 43 and producing a special yarn 61 having the appearance illustrated in FIG. 13 will now be described. As illustrated in FIG. 22, the electric control unit 38 includes a first computer 63 for setting a pattern of a special yarn 61 to be produced and a second computer 64 for storing control data indicating a pattern set by the first computer and controlling operation of the servo motor 43 by the control data of the stored pattern during spinning.

The first computer 63 acts as means for setting a pattern of change of the count number with respect to the length of a special yarn 61 to be produced. The first computer 63 is provided with a microcomputer 67 including a central processing device 65 and a memory device 66, an input device 68 such as a keyboard, an output device 69, and tape recorder 70. A flow chart shown in FIG. 15 is written in the ROM of the memory device 66. Since the setting of the pattern of the special yarn 61 based on this program is the same as that of the above-mentioned second embodiment, a detailed description will be omitted.

Figure 24:
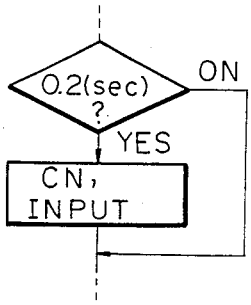
FIG. 24 is a flow chart of an interruption operation of the flow chart of FIG. 23.
Figure 23:
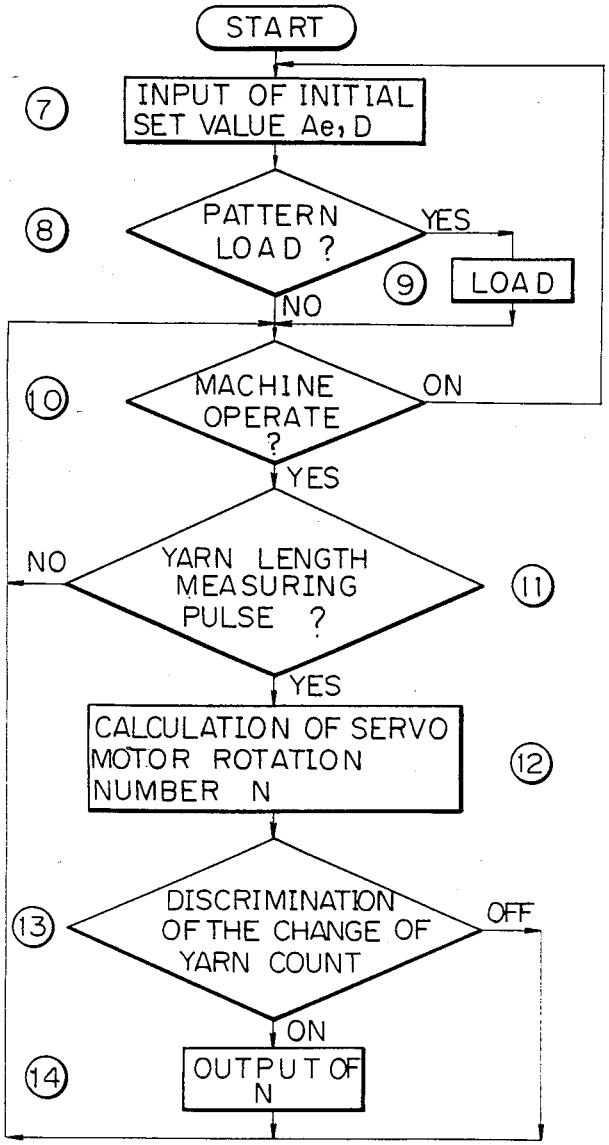
FIG. 23 is a flow chart of a procedure for producing the special yarn in accordance with the apparatus of FIG. 20.

The second computer 64 is a computer unit arranged for the corresponding machine frame as in the first embodiment and the second embodiment. As shown in FIG. 22, the second computer 64 includes a microcomputer 74 including a central processing device 72 and a memory device 73, an input device 75, an output device 76, an operation panel 77, a machine frame control device 78, and a motor control device 80 for controlling the operation of the servo motor 29. The RAM of the memory device 73 acts as memory means for storing control data of the pattern set by the first computer 63. The control data input from the first computer 63 is sequentially stored in the RAM of the memory device 73. The main program of the flow chart shown in FIG. 23 and the spin program of the flow chart shown in FIG. 24 are written in the ROM of the memory device 73. The main program and spin program are started by turning on a start switch of the operation panel 77 after starting the spinning operation in the spinning frame.

The operation of the driving system X and Y based on the main program will now be described. First, by rotating the driving motor 4, rotation of a driving pulley 4*a* of the driving motor 4 is transmitted to the front roller 7 of the draft zone 2 through the driving system X and to the delivery roller 106 and the traverse roller 108 through the driving system Y. Then, the front roller 7, the delivery roller 106, and the traverse roller 108 are cooperatively rotated. Further, rotation of the driving pulley 4*a* is transmitted to the back roller 9 and the second roller 8 through the first transmission system 101*a*, the differential gear 44, and the second transmission system 101*b* to rotate the back roller 9 and the second roller 8. In this case, the speed ratio between the front roller 7 and the back roller 9 is set so that where rotation of the servo motor 29 is stopped (or the servo motor 29 is rotated in a direction by a predetermined speed), a predetermined draft is given to a fiber bundle 122*a* and a spun yarn of the standard count number is spun. By normal and reverse rotations (or increase or decrease of speed) of the servo motor 29, the rotation number ratio between the front roller 7 and the back roller 9 is changed to change the count number (thickness) of the spun yarn. Further, rotating forces caused by two spiral nozzle bodies (not shown) and having opposite directions are applied to fibers fed in the nozzle 123, so that a false twist is applied to the fibers and a twisted yarn having a remaining twist is spun. Incidentally, a conveyor band and collector device may be arranged between the front roller 7 and the nozzle 123 so that the nozzle 123 is formed as a single spiral nozzle body.

When the main program is started where the spun yarn is spun by driving the driving motor 4 as described hereinbefore, the program advances to step (7) of "input of initial set value". At this step (7), the standard count number Ae and standard draft D of the spun yarn are input. When the values Ae and D are input, the program advances to step (8) of "pattern load". When there is an input of a pattern load signal, the program advances to step (9) of "pattern load". If there is no input of a pattern load signal, the program advances directly to the subsequent step (10) of "discrimination of operation of machine frame". If the machine frame is under operation, the program advances to step (11) of "discrimination of length measuring pulse". When at this step (11) a length measuring pulse is emitted from the pulser 57 (length-measuring device), the program advances to step (12) of "calculation of rotation number of servo motor". The length measuring pulse is emitted every time the spun yarn is spun by the standard unit length La (for example, 1 cm). At this step (12), the rotation number N of the servo motor 29 for controlling the change of the count number of the spun yarn at the position of the spun length measured by the length measuring pulse is calculated. The speed N of the servo meter 29 is calculated based on the initial data A0 of the control data A0 through An of the change of the count number stored in the memory device 73 and the detected value of the second pulse 57 (indicating the speed of the front roller 7) stored by the interruption operation, so that the speeds of the back roller 9 and second roller 8 are controlled to values giving the count number corresponding to the data A0 to the spun yarn. When these calculations are terminated, the program advances to step (13) of "discrimination of change of count number". Since a signal for requiring the change of the count number is input at this step (13) (in the case of producing a structure yarn, a snap switch for discrimination of change of count number is switched on when the frame is operated), the program advances to step (15) of "output of N", and the control value N calculated at the above-mentioned step (12) is output to the motor control device 80. Thus, the motor control device 80 controls the rotation of the servo motor 29 to control the speed of the back roller 9 so that the count number of the spun yarn corresponds to the control data A0. Then, the back roller 9 is rotated by a speed in which the count number of the yarn spun from the nozzle 123 becomes a size corresponding to the control data A0 and drafts the fiber bundle 122*a* with the front roller 7. Thus, the drafted fiber bundle 122*a* is supplied to the nozzle 123, is twisted and drawn as a twisted yarn having a false twist and true twist, and finally is wound to the cheese 107 by the traverse drum 113. Then, the program returns to step (10) of "discrimination of operation of machine frame". The above operation is repeated every time the length measuring pulse is emitted. Accordingly, the count number of the spun yarn is controlled by every standard unit length La, and a special yarn having a pattern preset by the pattern setting means is formed. The above-mentioned pattern is repeated by the continuous spinning to produce a special yarn having a predetermined length. Further the winding unit may be driven by another motor.

The other embodiment illustrated in FIG. 25 will now be described. For achieving the desired object, the speed of the back roller 9 is increased or decreased in the embodiment illustrated in FIG. 20. In the embodiment illustrated in FIG. 25, the speed between a front roller 7*e* and a delivery roller 106*e* is changed.

As shown in FIG. 25, the construction of the driving system Xe and Ye in this embodiment is the same as that of the driving system X and Y illustrated in FIG. 20. A speed change device 21*e* including a differential gear 44*e* and a servo motor 29*e* having the same construction as that illustrated in FIG. 20 is arranged in the driving system Xe. In the differential gear 44*e* of this embodiment, the output gear 24 of the embodiment illustrated in FIG. 20 is used as an input gear 24*e* to which rotation of the driving motor 4*e* is input. The input gear 22 of the embodiment illustrated in FIG. 20 is used as an output gear 22*e*. Further, a rotation detector 57*e* for detecting rotation number of the back roller 9*e* is arranged in the driving system Xe.

In this embodiment, as apparent from the drawing, by rotating the driving motor 4*e*, the rotation of the driving motor 4*e* is directly transmitted to a back roller 9*e* and a second roller 8*e*. A planetary gear 36*e* engaged with an inner gear 48*e* and a sun wheel gear 47*e* secured to a main shaft 46*e* and pivoted on the input gear 24*e* performs planetary movement by rotation of the input gear 24*e*, rotates the sun wheel gear 47*e*, outputs rotation of the driving motor 4*e* to the output gear 22*e* secured to the main shaft 46*e*, and rotates the front roller 17*e* to spin a yarn having the standard thickness. Incidentally, operation of the servo motor 29*e* is performed in approximately the same way as the embodiment illustrated in FIG. 20. Therefore a description of the operation of the servo motor 29*e* is omitted. Also, elements in this embodiment having the same or equivalent constructions as elements of the embodiment of FIG. 20 are given the same numeral with the suffix "e". Detailed descriptions regarding the above-mentioned elements will be omitted.

FIG. 26 illustrates a modification of the embodiments of FIGS. 20 and 25. In this embodiment, elements having the same or equivalent constructions as elements of the embodiments of FIG. 20 are given the same numerals with the suffix "f". Detailed descriptions regarding the above-mentioned members will be omitted.

In the embodiment illustrated in FIG. 26 a driving system Xf including rotation of a draft zone 2*f* is divided into a first driving system 101*f* for rotating a front roller 7*f* by a first driving motor 4*f* and a second driving system 110*f* for rotating a back roller 9*f* by a second driving motor 126 (a second roller 8*f* rotates in cooperation with the back roller 9*f*). A second driving motor 126 having a speed change function such as the servo motor is used as the speed change device and the first driving system 101*f* is arranged with a rotation detector 57*f* for detecting the speed of the front roller 7*f*.

In this embodiment, the second driving motor 126 is controlled electrically by the detected value of the rotation detector 57*f* and the speed of the second driving motor 126 is changed. The second driving motor 126 changes the speed of the back roller 9*f* as described in the embodiment illustrated in FIG. 20 to change the count number. It is possible to provide a speed change function to the first driving motor 4*f* of the embodiment illustrated in FIG. 20 and change the speed of the front roller 7*f* and the delivery roller 106*f*, as in the embodiment illustrated in FIG. 25. In this case, the rotation detector 57*f* is arranged in the second driving system 110*f*.

As is apparent from the foregoing description, the apparatus for producing the special yarn according to the third embodiment has excellent features as in the first embodiment and the second embodiment. Further, since the present invention is applied to an apparatus in which yarn is given a false twist by the air jet nozzle, it is possible to produce special yarn having a great variety of count numbers and to greatly reduce the cost for producing the yarn, compared with the embodiments of the ring-spindle spinning frame, open end spinning frame or the like.

We claim:

1. An apparatus for producing a special yarn formed by a fiber strand in which a plurality of fibers are arranged at random along the lengthwise direction thereof, in which special yarn, a yarn count number and a twist number of the yarn change along the lengthwise direction thereof; said apparatus comprising:

(a) a ring-spindle twisting winding mechanism for forming said special yarn from said fiber strand;

(b) a draft device for feeding said fiber strand to said ring-spindle twisting winding mechanism and comprising a front roller and a back roller;

(c) a first speed change device for changing a yarn count number and comprising a first differential gear and a first servo motor for changing a speed of said first differential gear, which are arranged at a point midway of a driving system between said front roller and said back roller;

(d) a second speed change device for changing a twist number of the yarn and comprising a second differential gear and a second servo motor for changing and controlling the speed of said second differential gear, which are arranged at a point midway of a driving system between a spindle and said front roller;

(e) pattern setting means for setting a pattern of change of the yarn count number and the twist number of the yarn formed by said ring-spindle twisting winding mechanism and said draft device with respect to the length of said special yarn to be produced;

(f) memory means for storing control data indicating said pattern set by said pattern setting means;

(g) length-measuring means for measuring a spun length of said special yarn;

(h) a first motor control means for operating said first servo motor with respect to length-measuring signals of said length-measuring means based on control data stored in said memory means and changing the yarn count number of spun yarn according to said pattern set by said pattern setting means; and (i) a second motor control means for operating said second servo motor with respect to length-measuring signals of said length-measuring means based on control data stored in said memory means and changing the twist number of the spun yarn according to the yarn count number.

2. An apparatus for producing special yarns according to claim 1, wherein said pattern setting means comprises a first computer device; said memory means comprises a second computer device; and control data concerning the pattern set in said first computer device is transmitted to said second computer device and stored therein.

3. An apparatus for producing special yarns according to claim 2, wherein said first computer device comprises a portable computer device; said second computer device is arranged for the machine frame; and said portable computer device controls a plurality of spinning frames.

4. An apparatus for producing special yarns according to claim 2, wherein said first computer device comprises data input means for the entry of length data indicating a spun length at each position for changing a count number of the special yarn to be produced and count number data indicating the change ratio of the count number to the standard count number, memory means for storing the input data therein, and Processing means for performing operational processing of control data indicating the variation ratio of the count number to the standard count number for every standard unit length based on the stored data.

5. An apparatus for producing special yarns according to claim 1, wherein said pattern setting means comprises data input means for the entry of length data indicating a spun length at each position for changing a count number of the special yarn to be produced and count number data indicating the change ratio of the count number to the standard count number, memory means for storing the input data therein, and processing means for performing operational processing of control data indicating the variation ratio of the count number to the standard count number for every standard unit length based on the stored data.

* * * * *